US009050486B2

(12) United States Patent
Reed

(10) Patent No.: US 9,050,486 B2
(45) **Date of Patent: *Jun. 9, 2015**

(54) ANATOMICAL STRETCHING DEVICE AND METHODS OF USE

(75) Inventor: Michael Reed, Scottsdale, AZ (US)

(73) Assignee: Power Stretch, LLC, Scottsdale, AZ (US)

( * ) Notice: Subject to any disclaimer, the term of this patent is extended or adjusted under 35 U.S.C. 154(b) by 358 days.

This patent is subject to a terminal disclaimer.

(21) Appl. No.: 13/185,501

(22) Filed: Jul. 19, 2011

(65) Prior Publication Data

US 2012/0015784 A1 Jan. 19, 2012

Related U.S. Application Data

(63) Continuation-in-part of application No. 12/488,903, filed on Jun. 22, 2009, now Pat. No. 7,981,015.

(51) Int. Cl.

*A63B 21/00* (2006.01)
*A63B 21/005* (2006.01)
*A63B 21/055* (2006.01)

(Continued)

(52) U.S. Cl.

CPC ..... *A63B 21/0058* (2013.01); *A63B 21/055* (2013.01); *A63B 21/153* (2013.01); *A63B 71/0054* (2013.01); *A63B 2023/006* (2013.01); *A63B 2071/0625* (2013.01); *A63B 2071/065* (2013.01); *A63B 2071/0655* (2013.01); *A63B 2071/0658* (2013.01); *A63B 2208/0228* (2013.01); *A63B 2208/0242* (2013.01); *A63B 2220/30* (2013.01); *A63B 2220/51* (2013.01);

(Continued)

(58) Field of Classification Search

CPC ..... A63B 2210/50; A63B 21/00069; A63B 2023/006; A63B 21/0552; A63B 21/1492; A63B 21/0442; A63B 21/1484; A63B 23/0227

USPC ..... 482/51, 72, 92, 121–127, 131, 482/135–139, 130, 133, 111–113, 129, 134, 482/148, 907, 1

See application file for complete search history.

(56) References Cited

U.S. PATENT DOCUMENTS 2,512,911 A * 6/1950 Benice ..... 482/72
4,445,684 A * 5/1984 Ruff ..... 482/131

(Continued)

FOREIGN PATENT DOCUMENTS

DE 3737980 A1 5/1989
WO 2009-150438 A1 12/2009

*Primary Examiner* — Stephen Crow
*Assistant Examiner* — Andrew S Lo
(74) *Attorney, Agent, or Firm* — The Noblitt Group, PLLC

(57) ABSTRACT

Apparatus, methods, and systems for increasing flexibility and/or stretching the muscles of a user generally comprise a user support set atop an enclosure. The enclosure houses mechanisms to actuate a cable system, wherein the mechanisms at least one of feed and retract a cable of the cable system. The apparatuses, methods, and systems also comprise footholds proximate to the user support to support at least the feet from a user, wherein the cable system actuates between the footholds, and wherein the footholds actuate in at least a lateral motion to further accentuate increasing flexibility and/or stretching the muscles. The apparatus, methods, and systems also comprise a control handle coupled to the cable system for the user to grasp, wherein the cable system actuates to either one of increase and release a tension to the grasped control handle, and wherein the control handle comprises at least one control to regulate the either one of increase and release the tension.

11 Claims, 14 Drawing Sheets

(51) Int. Cl.
*A63B 71/00* (2006.01)
*A63B 23/00* (2006.01)
*A63B 71/06* (2006.01)

(52) U.S. Cl.
CPC ..... *A63B 2220/58* (2013.01); *A63B 2225/50* (2013.01)

(56) References Cited

U.S. PATENT DOCUMENTS 4,456,247 A * 6/1984 Ehrenfried ..... 482/131
4,647,040 A * 3/1987 Ehrenfried ..... 482/131
4,846,461 A * 7/1989 Robards et al. ..... 482/72
4,877,239 A * 10/1989 Dela Rosa ..... 482/131
4,966,363 A * 10/1990 van der Hoeven ..... 482/140
5,108,090 A 4/1992 Reed
5,137,504 A * 8/1992 Mangini ..... 482/131
5,277,681 A * 1/1994 Holt ..... 482/112
5,360,382 A * 11/1994 Chi ..... 482/1
5,449,336 A * 9/1995 Sabel ..... 482/133
5,480,375 A * 1/1996 La Fosse et al. ..... 601/23
5,584,756 A * 12/1996 Grapengiser et al. ..... 482/92
5,601,527 A * 2/1997 Selkowitz ..... 601/23
5,616,110 A * 4/1997 Nascimento ..... 482/131
5,645,514 A * 7/1997 Chen ..... 482/72
5,707,322 A * 1/1998 Dreissigacker et al. ..... 482/72
5,728,034 A * 3/1998 Lamothe ..... 482/131
5,759,137 A * 6/1998 Huang ..... 482/72
5,904,641 A * 5/1999 Huang ..... 482/131
5,980,434 A * 11/1999 Webber ..... 482/100
6,210,348 B1 4/2001 Reed
6,352,495 B1 * 3/2002 Hsu ..... 482/92
6,634,995 B1 * 10/2003 Reed ..... 482/92
6,733,426 B2 * 5/2004 Bussell ..... 482/112
7,871,355 B2 * 1/2011 Yeh ..... 482/4
2003/0216227 A1 * 11/2003 Smith ..... 482/72
2004/0043874 A1 * 3/2004 Yang ..... 482/72
2006/0035755 A1 2/2006 Dalebout
2006/0094569 A1 * 5/2006 Day ..... 482/57
2006/0160674 A1 7/2006 Andrews
2007/0155587 A1 * 7/2007 Huang et al. ..... 482/1
2008/0261782 A1 * 10/2008 Campbell ..... 482/72
2009/0036276 A1 * 2/2009 Loach ..... 482/72
2010/0323860 A1 12/2010 Reed
2011/0028278 A1 * 2/2011 Roach ..... 482/72

* cited by examiner

ANATOMICAL STRETCHING DEVICE AND METHODS OF USE

CROSS-REFERENCE TO RELATED APPLICATIONS

This application is a continuation in part of and claims priority to U.S. patent application Ser. No. 12/488,903, filed Jun. 22, 2009, which is incorporated by reference herein.

FIELD

This patent application generally relates to exercise equipment.

BACKGROUND

Personal healthcare is a growing modern phenomenon as individuals become more and more health conscious. As part of a regular healthcare regiment, users incorporate various strength and conditioning programs. As part of such strength and conditioning programs, users often rely upon various exercise equipment. While much of this equipment is directed towards strength training, few are directed primarily with stretching and/or increasing a user's flexibility. It is well known that as a user's muscle develops, the muscles tend to lose a fair amount of flexibility. Also, a user undertaking a strength and conditioning regiment may be out of shape and lack adequately stretched muscles and/or have limited flexibility, which is a desired precursor to more advanced strength and conditioning.

However, devices, which are directed towards increasing flexibility and/or stretching muscles, are active devices that the user to exert physical effort to push and pull themselves in conjunction with the various equipment.

SUMMARY

Various embodiments provide an apparatus configured to increase flexibility and/or stretch the muscles of a user generally includes, among other elements, (a) a user support to support the user; (b) an enclosure, wherein the enclosure houses mechanisms to actuate a cable system; (c) footholds proximate to the user support to support feet from the user; and (d) a control handle for the user to grasp, wherein the control handle is coupled to the cable system.

The housed mechanisms operate to feed and retract a cable of the cable system, wherein the cable system may actuate between the footholds. In one embodiment, the footholds may actuate in a lateral direction to further accentuate increasing flexibility and/or stretching muscles. However, in other embodiments the footholds may actuate in a longitudinal direction, as well as in combinations of both lateral and longitudinal direction. The cable system operates to either one of increase and release a tension of the grasped control handle, and the control handle may comprise at least one control to regulate the either one of increase and release the tension.

A passive device is disclosed that a user can operate to increase flexibility and/or stretch their muscles without exerting great physical effort, thereby obtaining a complete stretching before tiring from any pushing or pulling.

BRIEF DESCRIPTION OF THE DRAWINGS

The present disclosure will become more fully understood from the detailed description and the accompanying drawings, wherein.

DETAILED DESCRIPTION

Figure 1:
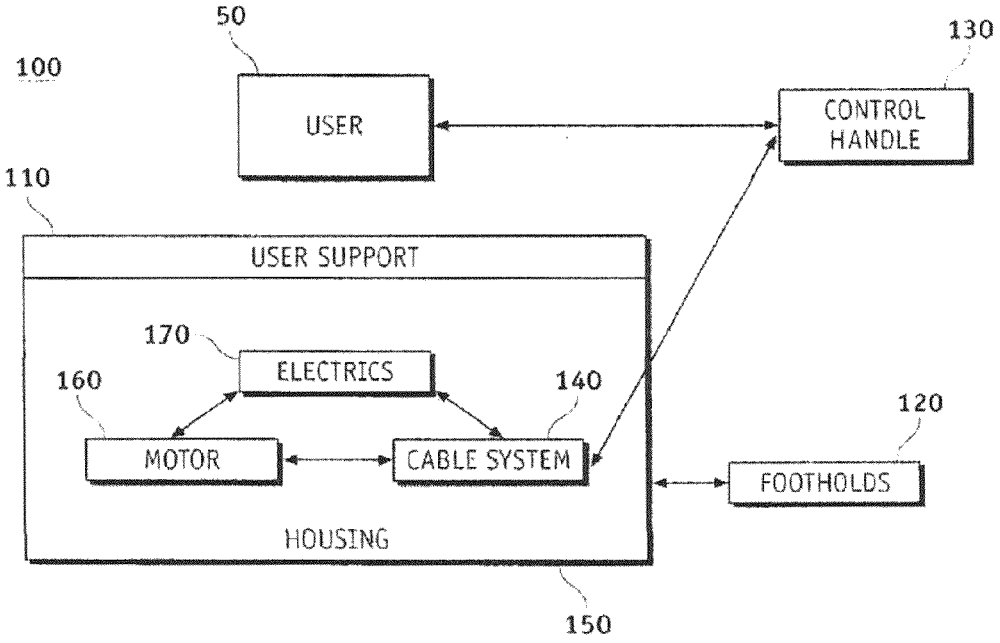
FIG. 1 is a block diagram illustrating an apparatus, according to various embodiments.

The following description is merely exemplary in nature and is in no way intended to limit the present disclosure, its application, or uses. For purposes of clarity, the same reference numbers will be used in the drawings to identify similar elements. As used herein, the phrase "at least one of A, B, and C" should be construed to mean a logical (A or B or C), using a non-exclusive logical or. As used herein, the phrase "A, B and/or C" should be construed to mean (A, B, and C) or alternatively (A or B or C), using a non-exclusive logical or. It should be understood that steps within a method may be executed in different order without altering the principles of the present disclosure. As used herein, the terms "comprise", "comprises", "comprising", "having", "including", "includes" or any variation thereof, are intended to reference a non-exclusive inclusion, such that a process, method, article, system, composition or apparatus that comprises a list of elements does not include only those elements recited, but may also include other elements not expressly listed or inherent to such process, method, article, system, composition or apparatus.

The drawings described herein are for illustration purposes only and are not intended to limit the scope of the present disclosure and the claims in any way. It is understood that the drawings are not drawn to scale and that like reference numbers refer to like elements throughout the drawings.

Various embodiments may be described in terms of functional block components and various processing steps. For example, some embodiments may employ various user supports and mechanism enclosures, footholds, control handles, cable systems, and the like, which may be employed for variety of functions. In addition, some embodiments may be practiced in conjunction with any number of strength and conditioning equipment. Further, some embodiments may employ any number of conventional techniques for increasing flexibility, stretching muscles, and the like.

In various embodiments, apparatus, methods, and systems for increasing flexibility and/or stretching the muscles of a user generally comprise a user support set atop an enclosure. The enclosure houses mechanisms to actuate a cable system, wherein the mechanisms at least one of feed and retract a cable of the cable system. The apparatuses, methods, and systems also comprise footholds proximate to the user support to support at least the feet from a user, wherein the cable system actuates between the footholds, and wherein the footholds actuate in at least a lateral motion to further accentuate increasing flexibility and/or stretching the muscles. The apparatus, methods, and systems also comprise a control handle coupled to the cable system for the user to grasp, wherein the cable system actuates to either one of increase and release a tension to the grasped control handle, and wherein the control handle comprises at least one control to regulate the either one of increase and release the tension.

Various embodiments may be applied to any apparatus for stretching muscles and/or increasing flexibility for a user. As described herein, it is understood that stretching muscles can increase flexibility of a user. Accordingly, the apparatus, as described herein, may be used to at least one of stretch muscles and increase flexibility of a user. However, it is also understood that the stretching and/or the maneuvering of a joint, such as for example, a knee, hips, discs of a spinal column, and combinations thereof, can increase the flexibility of a user. It is also understood that routines that repeatedly stretch muscles and/or joints can strengthen those muscles. It is understood that the term muscle, as used herein, can include tendons, ligaments, and other related connective tissue. It is also understood that the term joint, as used herein, can include cartilage, tendons, ligaments, connective tissue, and other related tissue. It is also understood that the term joint, as used herein, can include artificial implanted devices that replace or stabilize a damaged or worn joint, such as for example, a knee replacement, or a rebuilt hip.

Various embodiments of the apparatus enable multiple methods of stretching. The apparatus can include a frame that is attached to a motor. One end of a cable can be attached to the motor. The cable wraps around a pulley that is attached to the frame. The cable attaches to a handle which can be integrated with the apparatus's controls. The user may grasp the handle during some stretching exercises. An attachment for stretching one's legs can also coupled to the frame and the motor. The user's foot may be placed on a foothold. There may be multiple footholds, accommodating the knee being straight or bent. The position of the foothold may also be adjusted, in order to accommodate users of varying heights. The attachment can be controlled and can be moved outward from the frame, inducing a stretch in the user's leg. The system controls can comprise electronics containing memory, which will enable the apparatus to run a predetermined program or to repeat the same stretches performed in a previous exercise session.

Referring now to FIG. 1, a block diagram illustrates one embodiment of an apparatus 100 to stretch the muscles of a user 50. In accordance with one embodiment, the apparatus 100 may comprise a user support 110 to support the user 50, footholds 120, which may be proximate to the user support 110 to support feet from the user 50, and a control handle 130 for the user 50 to grasp. The control handle 130 may be coupled to a cable system 140, and in conjunction with the user support 110 and the footholds 120, the cable system 140 may actuate to facilitate stretching at least one a muscle and a joint of the user 50, which may increase flexibility. In one embodiment, the user support 110 may set upon an enclosure 150 that may fully or partially house the cable system 140, as well as house various hardware components, such as for example, a motor 160. The enclosure 150 may further house various other components, such as for example, electronics 170, drive systems, displays, computational devices, and the like.

In various embodiments, apparatus 100 can comprise platform, motor 160 coupled to the platform, seat mounted to the platform, rotating disk center-mounted to the platform, cable 140 coupled to motor 160 and interfaced with the rotating disk, handle 130 coupled to the cable and controller interfaced to motor 160 and configured to control at least one of cable 140 tension and motor 160 rotation. In one embodiment, motor is configured to increase tension and release tension in the cable.

In some embodiments, apparatus 100 can further comprise leg component pivotally coupled to the platform and in communication with motor 160. Leg component can comprise an adjustment mechanism configured to accommodate different sized bodies. Further, leg component can comprise at least one foothold, which can include an adjustment mechanism configured to accommodate different sized bodies. Apparatus can comprise a memory system in communication with the controller.

In various embodiments, apparatus 100 can comprise platform, motor 160 coupled to the platform, seat mounted to the platform, rotating disk coupled to motor 160, an arm interfaced with the rotating disk, handle 130 couple to the arm and controller interfaced to motor 160 and configured to control motor 160 rotation. In one embodiment, the arm is can be configured to accommodate different sized bodies. In one embodiment, the arm can comprise two members pivotally coupled.

Figure 2:
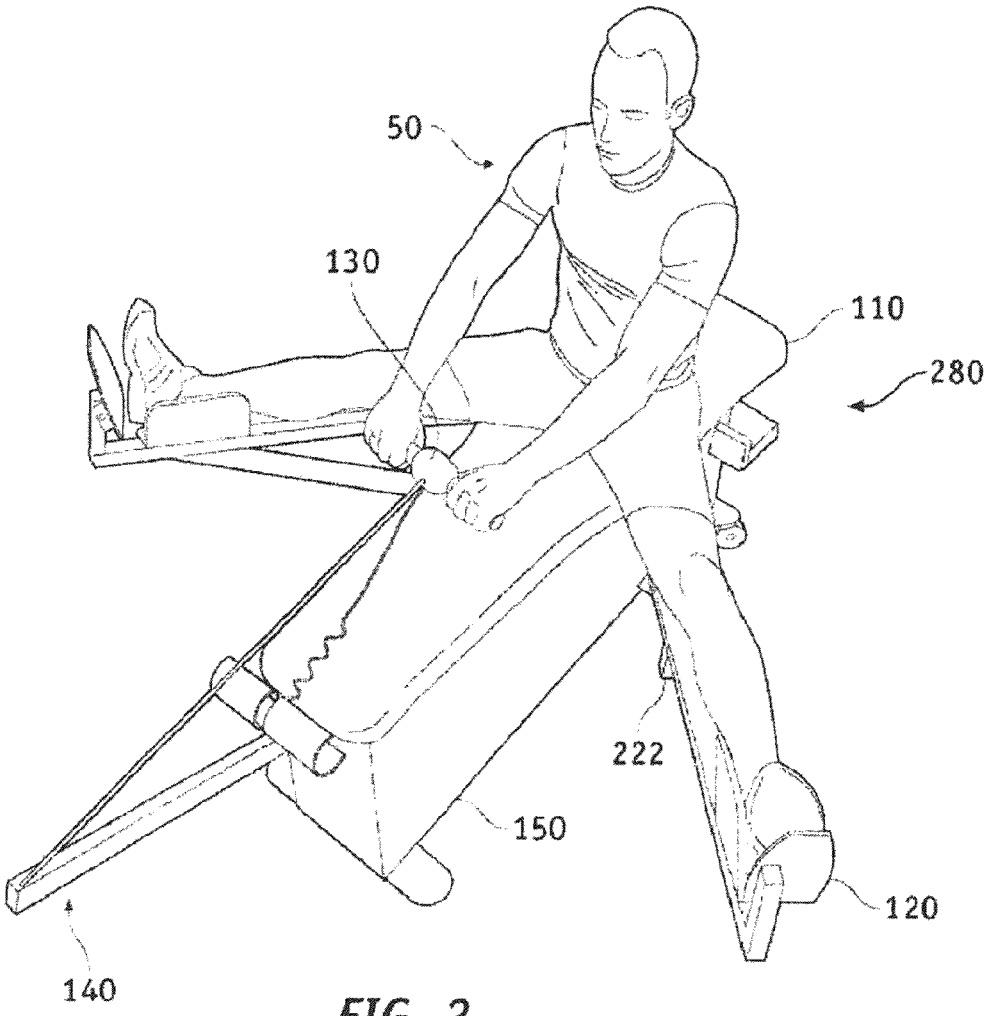
FIG. 2 is a prospective view illustrating a user in communication with an apparatus, according to various embodiments.
Figure 3:
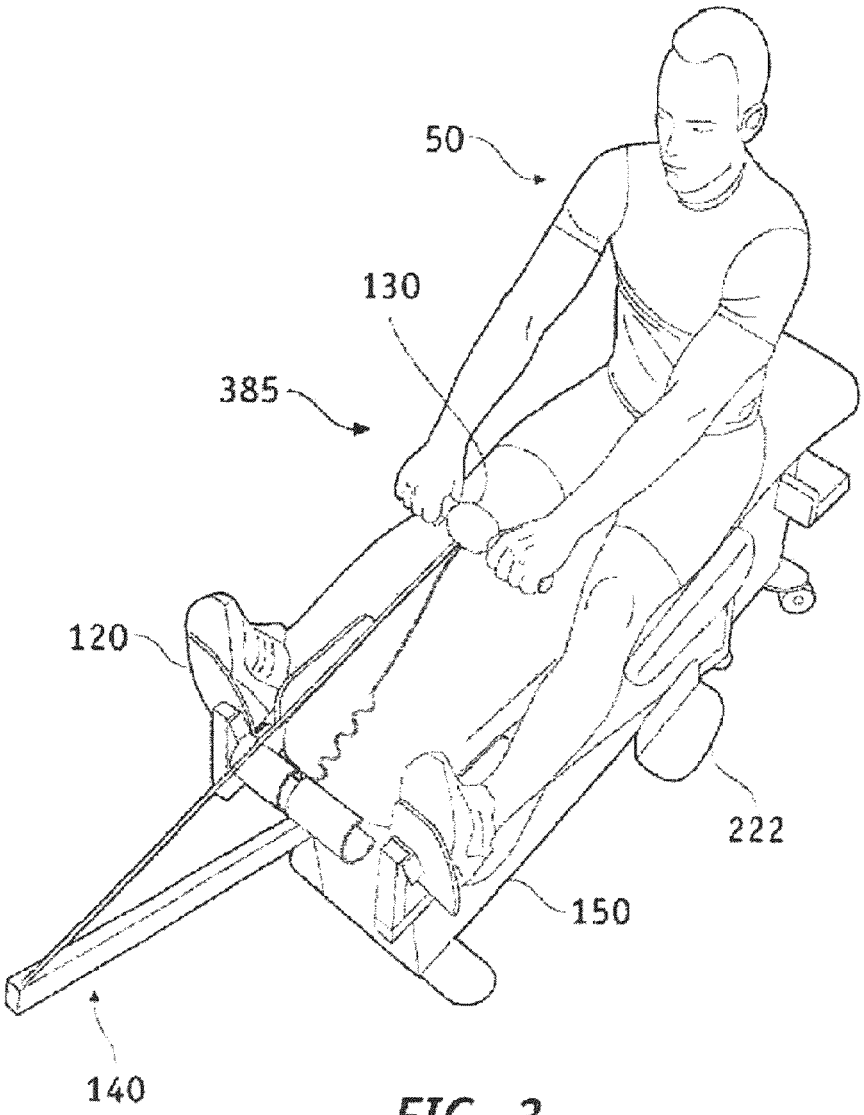
FIG. 3 is a prospective view illustrating a user in communication with an apparatus, according to various embodiments.
Figure 17:
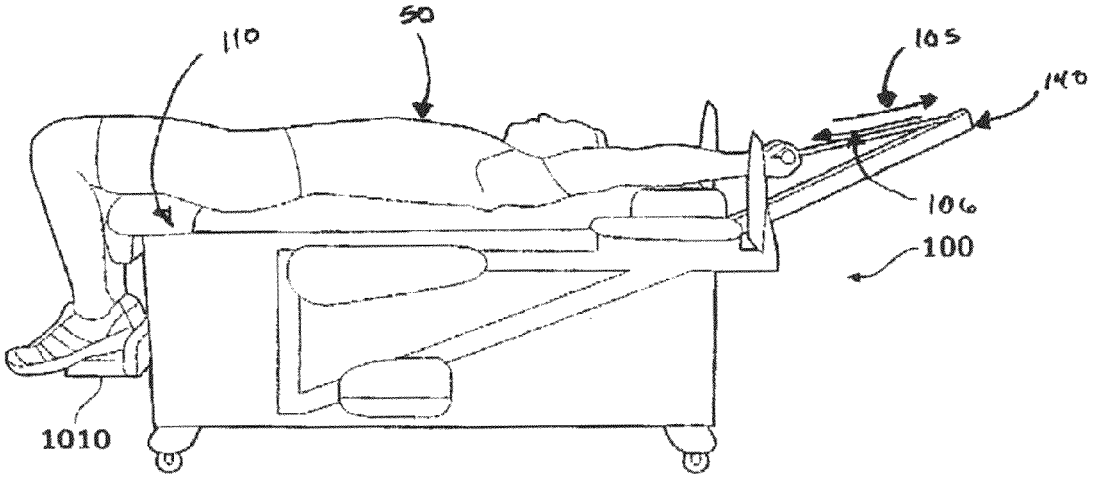
FIG. 17 is a side view illustrating an example of a method of use, according to various embodiments.
Figure 18:
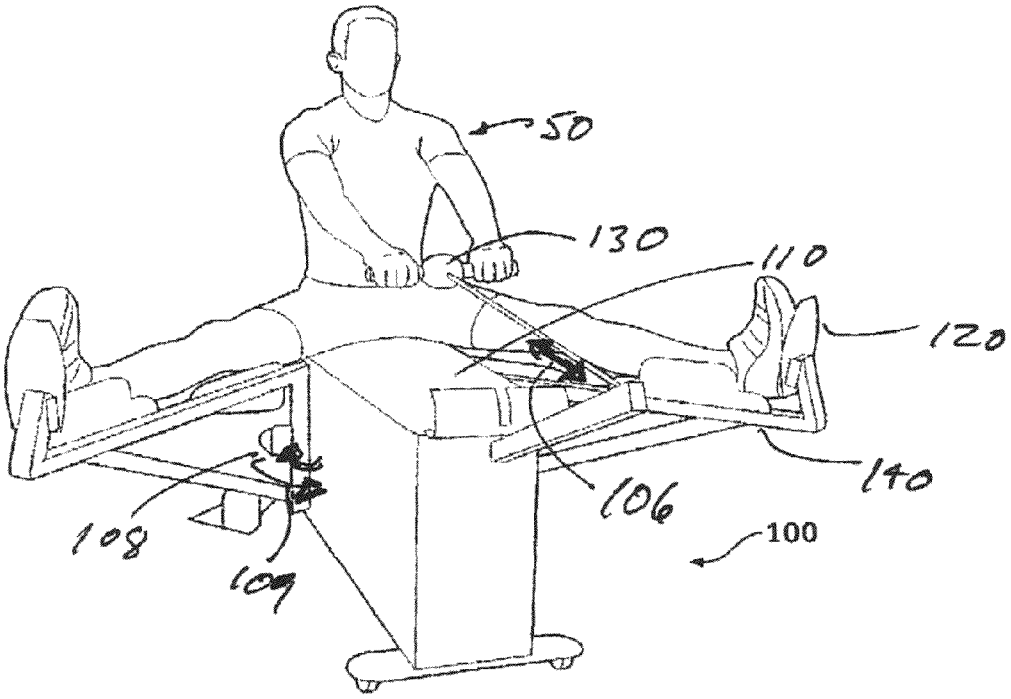
FIG. 18 is a prospective view illustrating an example of a method of use, according to various embodiments.

With reference to FIGS. 2 and 3, an example of a user support 110 is illustrated to support the user 50. In one embodiment, the user support 110 may support the user 50 during use of the apparatus 100. In some embodiments, the user support 110 may comprise a bench that sets or is fastened atop the enclosure 150. In some embodiments, the user support 110 may comprise a seat having a back to also support the user 50. In still another embodiment, the user support 110 may comprise an extension 1010 coupled to other parts of the enclosure 150 to support the knees or feet of the user 50, such as illustrated in FIGS. 17 and 18, or the user support 110 may comprise any other component now known or developed in the future that may support a user 50. Among the embodiments, the user support 110 may be adjustable to accommodate variable sized users. The user support 110 may also comprise a lap belt to secure the position of the user 50.

Among various embodiments, the user support 110 may comprise various materials, padding, and the like to facilitate comfort and hygienic maintenance.

In accordance with another embodiment, to further facilitate stretching a user's muscles and/or increase flexibility, the user support 110 and/or 1010 may actuate to alter the position of the user 50. For example, the user support 110, such as a seat having a back, may systematically, during operation of the apparatus, move in a back and forth motion, in an up and down motion, or a side to side motion, and/or any combination thereof.

In accordance with various embodiments, the apparatus 100 may comprise footholds 120, wherein the footholds 120 may be configured to support feet from the user 50. Again with reference to FIGS. 2 and 3, footholds are illustrated in use by the user 50. The footholds 120 may be substantially proximate to the user support 110 and may be suitably coupled to one or a combination of the user support 110, the enclosure 150, and/or actuation mechanisms, such as the motor 160, the cable system 140, and the like. As illustrated by FIGS. 2 and 3, the footholds 120 may be adjustable to accommodate various positions of the user 50 during use of the apparatus 100, as well as to accommodate the various sizes of various users. The footholds 120 may comprise not only elements to hold the user's feet, but may also comprise members that couple the footholds 120 to other above disclosed elements to assist in supporting any one or combination of the user's ankles, calves, thighs, etc. In accordance with one embodiment, the footholds 120 may be variably positioned, for example the apparatus 100 may comprise upper footholds, such as footholds 120, but the apparatus 100 may also comprise lower footholds, such as footholds 222 and representatively illustrated in use by the user 50 in FIGS. 13 and 16.

Figure 4:
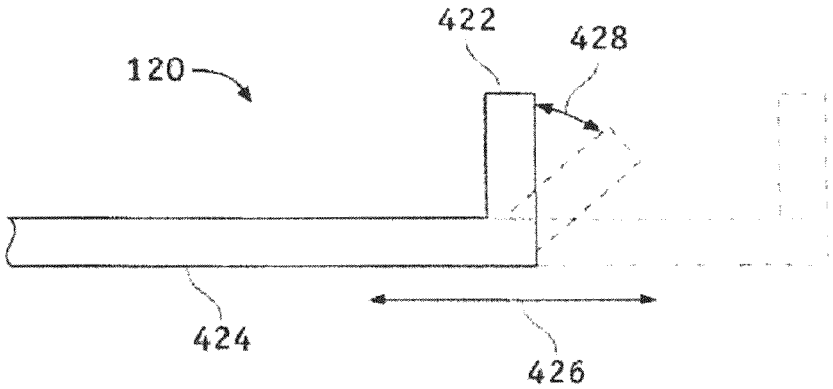
FIG. 4 is a diagrammatic side view of a portion of a foothold, according to various embodiments.

With reference to FIG. 4, a side view of a foothold 120 is illustrated. The foothold 120 may comprise a footplate 422, which may be suitably coupled to a foothold member 120. As illustrated in FIG. 4, the foothold 120 may be adjustable. For example, the foothold member 120 may adjust in a telescopic or any other extending/retracting manner, as illustrated by direction arrow 426, to accommodate the preferences of the user 50. Moreover, the footplate 422 may be adjustable in a pivot wise manner, as illustrated by the direction arrow 428, to also accommodate the preferences of a user 50. In some embodiments the foothold plate 422 and/or the foothold member 120 may lock in position by clips, pins, hooks, snaps, and the like to secure their respective positions. In other embodiments, though, the foothold plate 422 and/or the foothold member 120 may be free to move during use of the apparatus 100 by the user 50. While the foothold 120 may be used to support the feet of the user 50, the foothold 120 may also fully and/or partially support the legs of the user 50.

Figure 5:
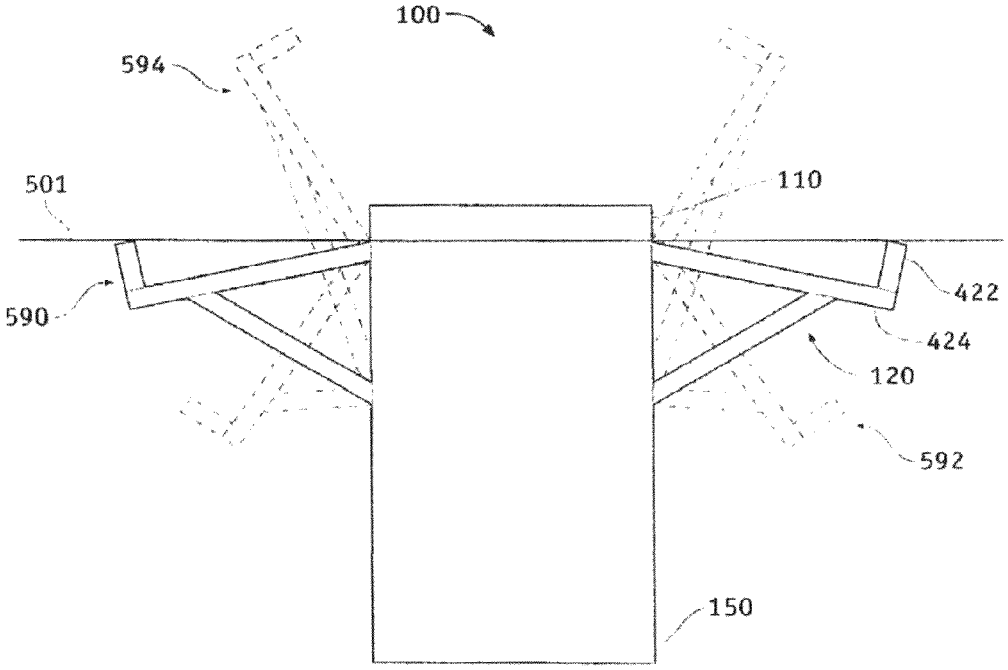
FIG. 5 is a diagrammatic top view illustrating an apparatus having a plurality of foothold positions, according to various embodiments.

With reference to FIGS. 2 and 3, the footholds 120 may be configured to facilitate supporting the legs and/or feet of the user 50 such that when the user 50 is seated upon the user support 110 the user 50 may comprise a seated straddled position. To facilitate this position, the footholds 120 may be configured to be substantially coplanar with the user support 110. In other embodiments, however, the footholds 120 may be alternately positioned such that feet and/or legs of the user 50 may be positioned above and/or below the plane of the user support 110. For example, with reference to FIG. 5, a front view of the apparatus 100 illustrates the footholds 120 in a standard substantially coplanar position 590 with the user support 110, for example plane 501. FIG. 5 also illustrates the footholds 120 in alternate positions, position 592 and 594; wherein either one or both of the footholds 120 may be positioned below the plane 501 of the user support 110, position 592, and/or above the plane 501 of the user support 110, position 594.

Figure 6:
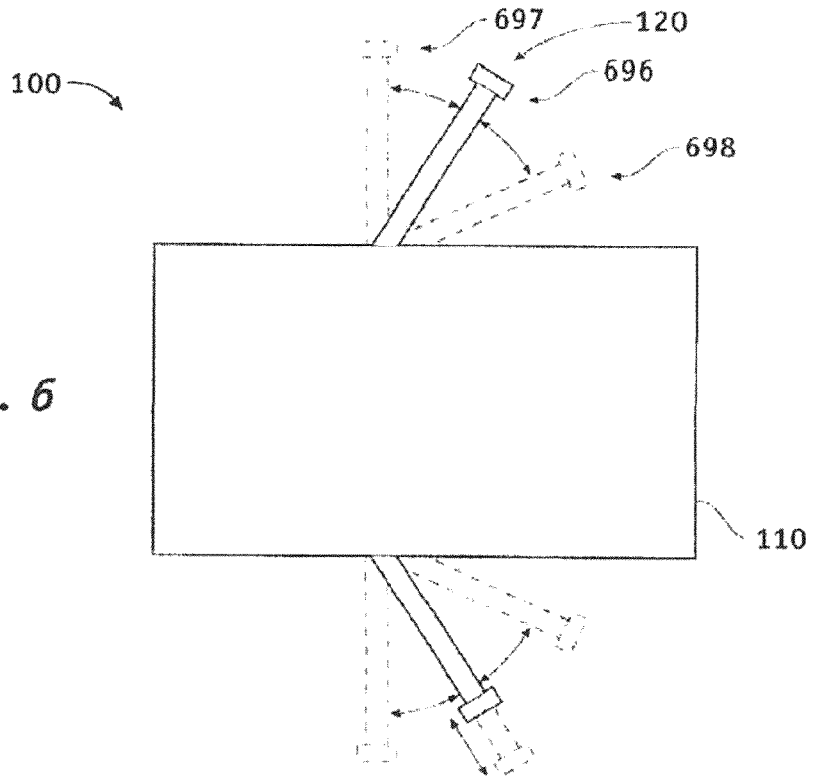
FIG. 6 is a diagrammatic top view illustrating an apparatus having a plurality of foothold positions, according to various embodiments.

With reference to FIGS. 2, 3, and 6, still other positions of the footholds 120 may be incorporated by the user 50 as they use the apparatus 100. These FIGS illustrate the various lateral positions the footholds 120 may be positioned at during use. For example, FIG. 2 illustrates the user 50 in a substantially straddled position, position 280, wherein the users legs are spread wide apart, thereby fostering a first type of muscle stretching when using the apparatus 100. FIG. 3, illustrates the user in an alternate position, position 385, wherein the user's legs are positioned substantially closer together, thereby fostering a second type of muscle stretching.

In one embodiment and with reference to FIG. 6, a top down view of the footholds 120 of the apparatus 100 are illustrated among a range of various lateral positions. For example, FIG. 6 illustrates the footholds 120 in a first position, position 696, but either one or both of the footholds 120 may be positioned in other manners, such as a wider position, as illustrated by position 697, and/or a narrower position, as illustrated by position 698, as well as any other position in between, farther apart, or closer together.

It should be noted that during use of the apparatus 100 by the user 50, the various positions of the footholds 120 may be set and secured in a desired position prior to use, but in some embodiments, the footholds 120 may comprise actuation mechanisms such that the positions of the footholds 120 may change during use.

It should further be noted that the various positions and/or configurations of the footholds 120 described above may also apply to the lower footholds 222. Moreover, any of the user 50 positions described herein, may further apply to the various user positions, for example, but not limited to those illustrated in FIGS. 10A-18.

In accordance with one embodiment, the apparatus 100 may comprise control handle 130. Control handle 130 may be used to further facilitate increasing the flexibility and/or stretching the muscles of the user 50. In one embodiment, the control handle 130 may be coupled to a cable of the cable system 140, wherein the cable system actuates to retract and/or feed the cable, thereby increasing and/or releasing the tension on the cable. In this manner, the increasing tension facilitates pulling the user 50 holding the control handle 130, and when the user 50 is positioned as illustrated and described above, such increasing tension facilitates the muscle stretching, thus increasing the flexibility of the user 50. The decreasing tension allows the user 50 to return to their starting position.

For example, with reference to FIG. 2 the user 50 is illustrated in a substantially starting position, sitting upright with the cable extended. FIG. 3 illustrates the user 50 in a substantially final position, sitting bent over with the cable retracted. As can be seen from these FIGS, repeated motions between the starting position and final position can effectively stretch the muscles of the user 50, thus increasing flexibility.

Figure 7:
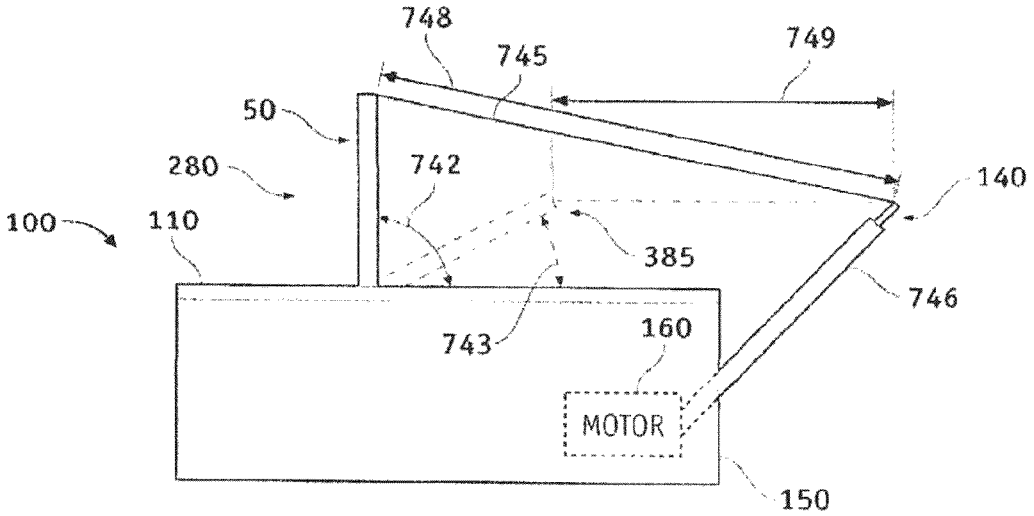
FIG. 7 is a block diagram illustrating an apparatus, according to various embodiments.

As a further example and with reference to FIG. 7, a schematic of the movement between the starting and final position is illustrated. The user 50 set upon the user support 110 may comprise the initial upright position 280. In this position the cable 745 of the cable system 140 may comprise a beginning extended length 748. In the final position, position 385, the user 50 may comprise a final bent over position 385. In this position the cable 745, may comprise a final retracted length 749. By holding onto the control handle 130, the user is pulled from position 280 to position 385, thereby decreasing the angle between the user, i.e. the user's torso, and the user support 110; illustrated by angle arrows 742 and 743. It should be noted that among some embodiments and to prevent injury to the user 50, the cable system 140 may release the tension on the cable 745 if and/or when the cable tension achieves a predetermined value. In this manner, the user 50 is safe from hyper extending themselves, thereby preventing injury, such as pulling and/or tearing their muscles.

In one embodiment, cable 745 can be replaced with a substantially straight rod which is coupled to extension arm 746 by a linkage. Motor 160 can move arm 746 at least one direction thus moving straight rod with handle attached. In some embodiments, motor 160 can move arm 746 in a forward or a backward motion that is substantially parallel to support 110. The user 50 may be stretched by holding handle 130 which is attached to straight rod that is pulled away from the user 50 by movement of arm 746 that is initiated and powered by motor 160.

Figure 8:
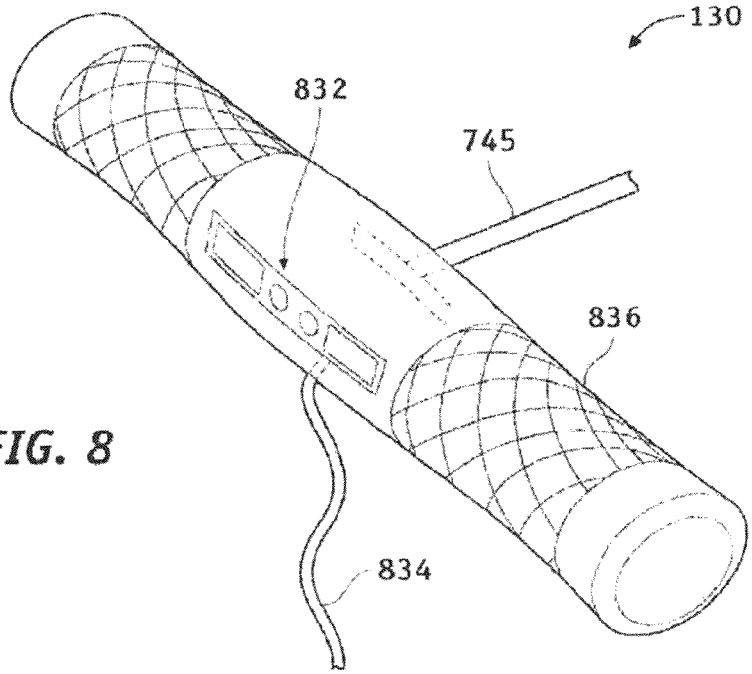
FIG. 8 is a prospective view illustrating a control handle, according to one embodiment.

With reference to FIG. 8, a close up of control handle 130 is illustrated. In one embodiment, control handle 130 may comprise controls 832, cable 745, control communication cable 834, and/or hand grips 836. Controls 832 may comprise various electronic switches, controls, settings, and the like to facilitate operation of the apparatus 100. The controls may comprise simple on/off switches or may comprise variable resistance type switches to control, for example, variable value levels. For example, the controls 832 may actuate the extension and/or retraction of the cable 745. The controls may operate the cable system 140 as well as any foothold 120 movements and/or settings. The controls 832 may also control power, speed, timing, cable 745 tension levels, and the like. In some embodiments, the controls 832 may further comprise visual displays and/or other outputs, such as audio and touch sensory feedback mechanisms. Among the various embodiments, the controls 832 may communicate with other apparatus 100 components via the control communication cable 834, but in some embodiments, the communication may be conducted wirelessly using infrared and/or radio receiving/transmission elements. In still other embodiments the control communication cable 834 and/or any wireless embodiments may communicate with not only other components of the apparatus 100, but may also be configured to communicate with other devices, such as a PC, a cell phone, a PDA, and the like so as to convey usage information. Such usage information may be useful to track a user's progress, to monitor maintenance schedules, and the like. In still yet other embodiments, in addition to control communication cable 834 and/or any other wireless embodiments, the control handle 130 may comprise internal memory capabilities, removable memory capabilities, and the like to further store and/or provide information.

In accordance with various embodiments, the control handle 130 may comprise grips 836 for the user 50 to hold during use of the apparatus 100. In the example illustrated in FIG. 8, the control handle comprises a straight bar comprising textured areas 836 to facilitate a secure grip by the user 50. It should be understood, however, that any type of control handle configuration may be used without departing from the scope of the various embodiments described herein. For example, the control handle 130 may comprise contoured portions to conform more readily to the user's grasp, or the control handle 130 may comprise other shape configurations, such as a T-bar, an H-bar, and the like.

In accordance with various embodiments, the apparatus 100 may comprise cable system 140. The cable system 140 may suitably couple the control handle 130 to a drive mechanism, such as the motor 160, which may operate to feed and/or retract the cable 745 thereby respectively increasing and/or releasing tension in the cable 745, and thus facilitating the use of the apparatus 100 to increase flexibility and/or stretch the muscles of the user 50. With return reference to FIG. 7, the cable system 140 may comprise the cable 745 that may be suitably coupled, via extension arm 746, to an internal drive motor 160. As briefly described above, when the user 50 is in the beginning upright position 280, the cable system comprising the cable 745 may comprise a beginning extended length 748. In the final position, position 385, the user 50 may comprise a final bent over position 385 when the cable 745 comprises a final retracted length 749.

In accordance with various embodiments, using the controls 832 on the control handle 130, the user 50 may initiate the cable system 140. For example, the motor 160 may be actuated via the controls 832 to begin retracting the cable 745, thereby increasing the tension on the cable 745, and thus pulling the user 50. Once the user 50 reaches the final position 385, the motor 160 may reverse direction to feed cable 745, thereby decreasing the tension on the cable 745, thus allowing the user 50 to return to the starting position 280.

Figure 9:
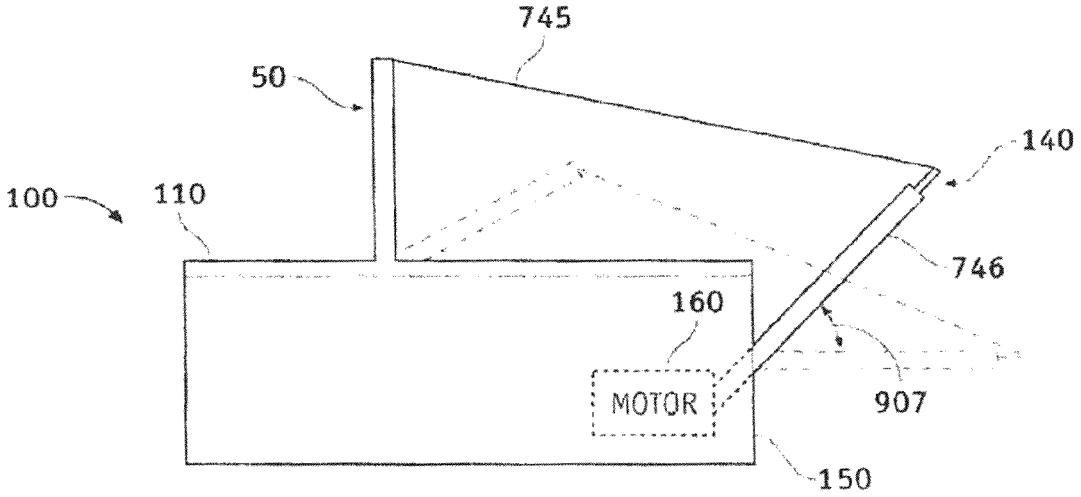
FIG. 9 is a block diagram illustrating an apparatus, according to various embodiments.

In accordance with various embodiments, the cable system 140 may not operate to feed or retract the cable 745, but rather, as illustrated in FIG. 9, the cable 745 may be fixed and the motor 160 may operate to raise and/or lower the extension arm 746 to facilitate moving the user from the starting position 280 to the final position 385, direction arrow 907. In still yet another embodiment, the cable system 140 may be configured to feed and/or retract the cable 745 as well as raise and/or lower the extension arm 746. It should be noted that the retraction and feeding of the cable 745, and the raising and/or lowering of the extension arm 746 are merely two examples of components that facilitate any "pulling" and/or "releasing" of the user 50 to effectuate increasing flexibility and/or stretching their muscles. It should be appreciated that any other like components that facilitate such movement of the user 50 are contemplated by this disclosure, for example, rods, pistons, pulleys, gears, fly wheels, levers, screws, etc.

Figure 10A:
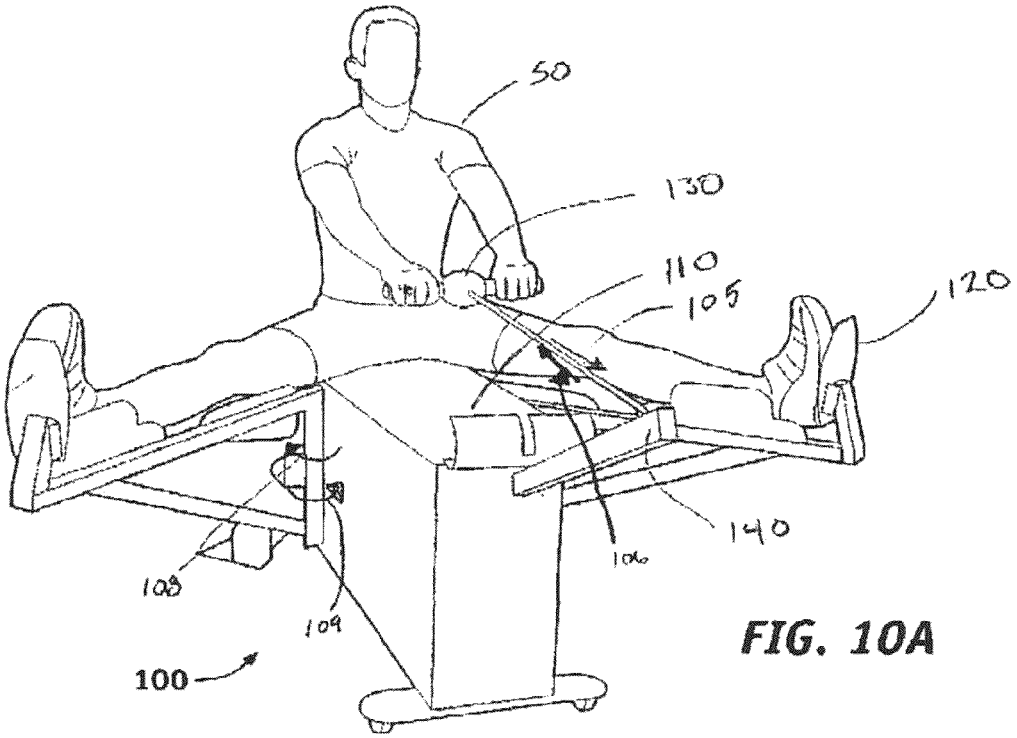
FIGS. 10A and 10B are prospective views illustrating examples of methods, according to various embodiments.
Figure 10B:
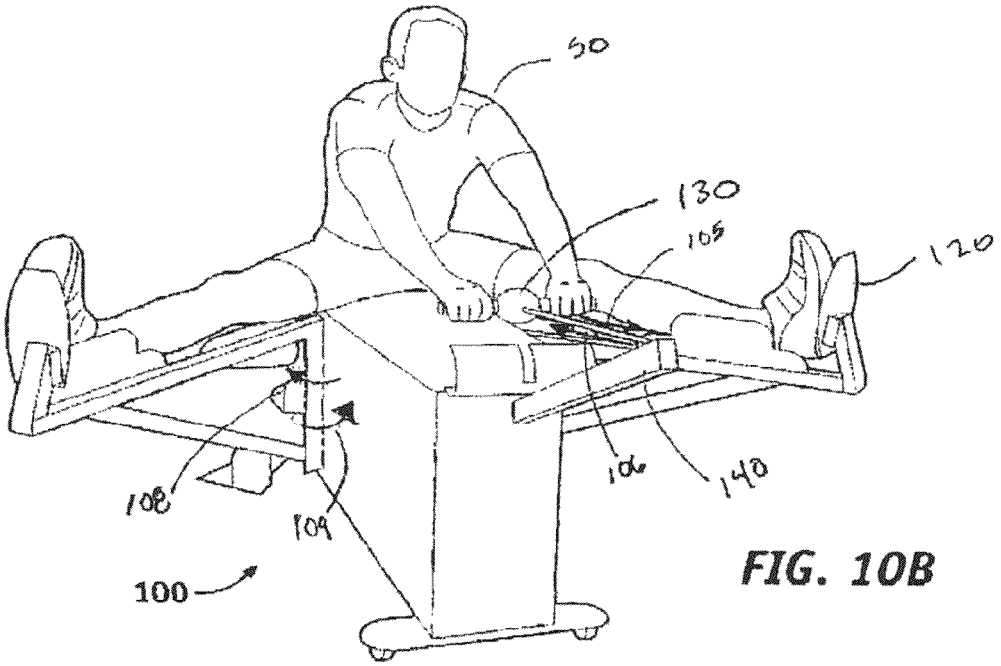
Figure 11:
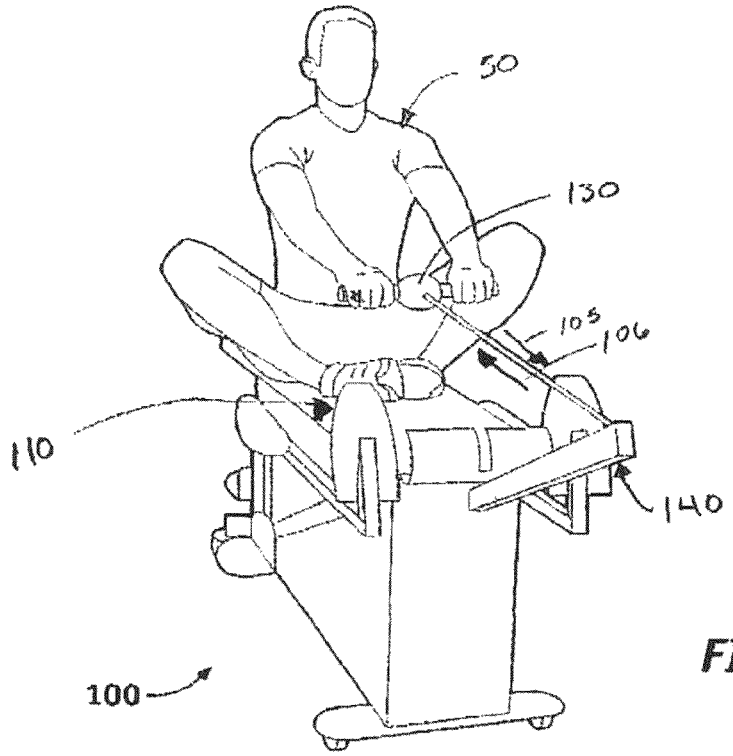
FIG. 11 is a prospective view illustrating an example of a method of use, according to various embodiments.
Figure 12:
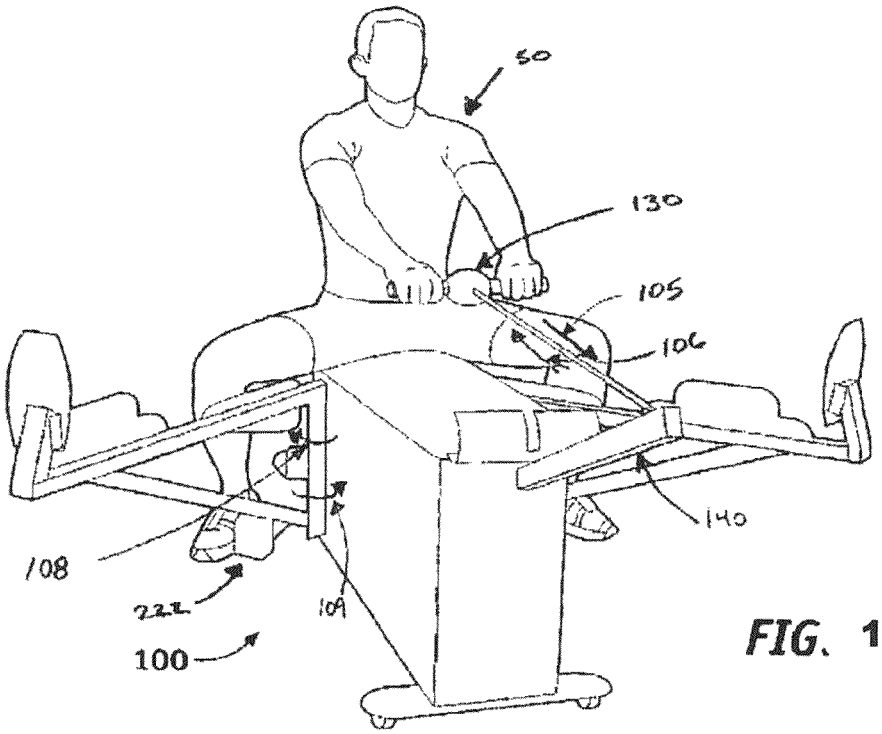
FIG. 12 is a prospective view illustrating an example of a method of use, according to various embodiments.
Figure 13:
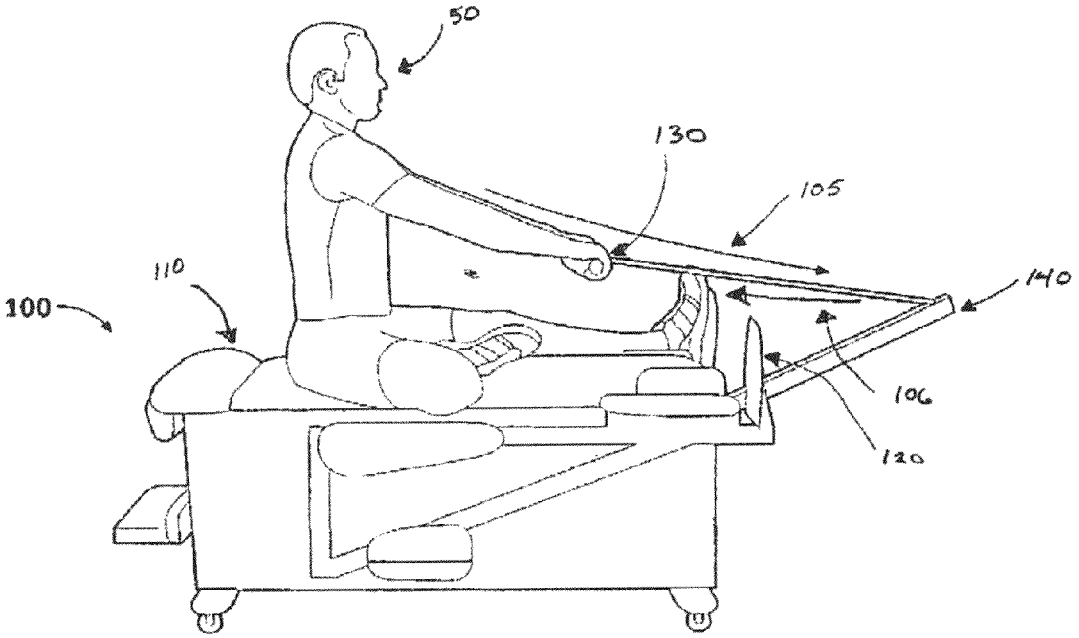
FIG. 13 is a side view illustrating an example of a method of use, according to various embodiments.
Figure 14:
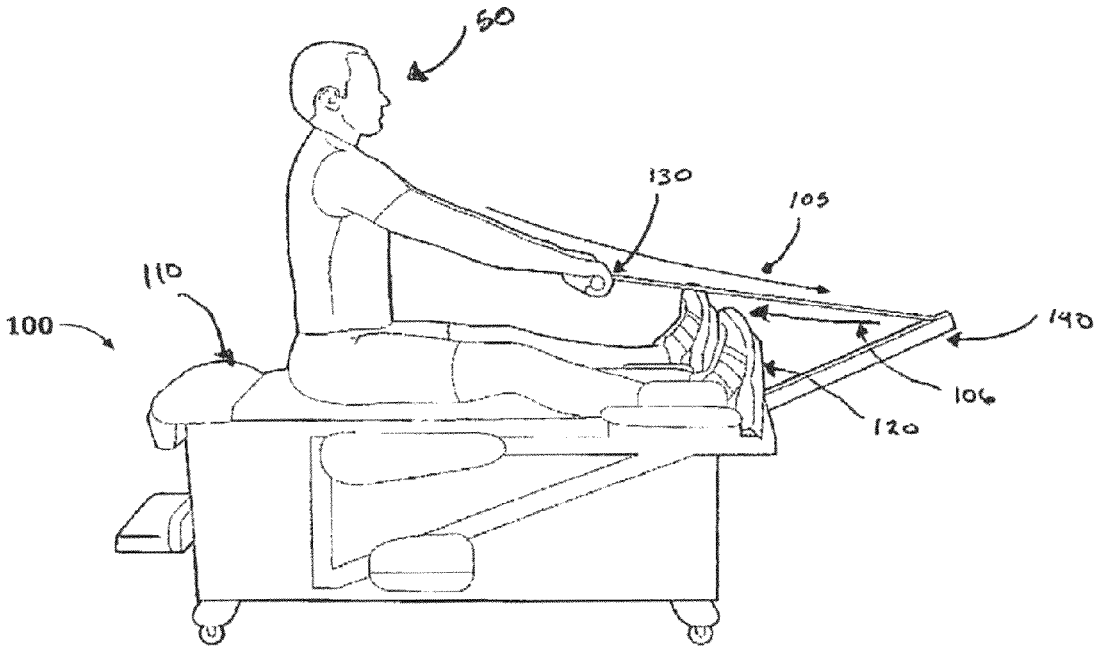
FIG. 14 is a side view illustrating an example of a method of use, according to various embodiments.
Figure 15:
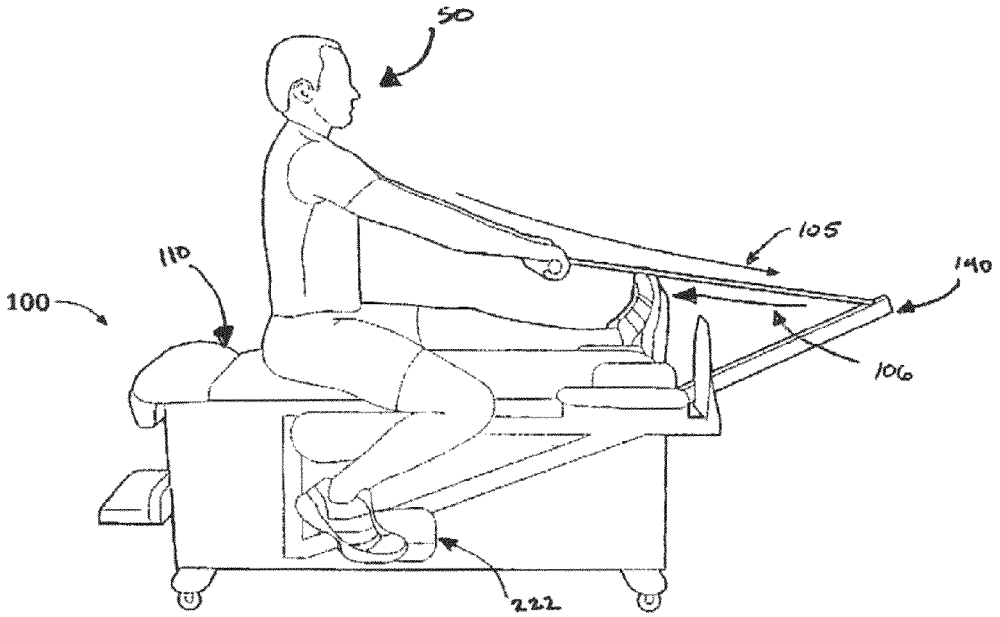
FIG. 15 is a side view illustrating an example of a method of use, according to various embodiments.
Figure 16:
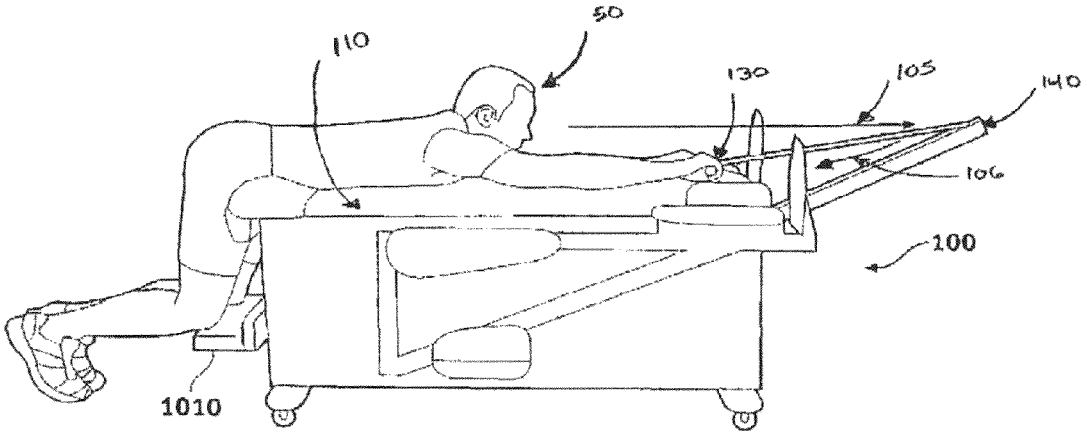
FIG. 16 is a side view illustrating an example of a method of use, according to various embodiments.

In accordance with various embodiments, and as mentioned briefly earlier, the user 50 may employ many variable positions to realize the benefits of the apparatus 100, and FIGS. 10A-18 representatively illustrate many, but certainly not all of the possible positions. For example, FIG. 10A illustrates a standard splits position, FIG. 10B illustrates a splits forward position, FIG. 11 illustrates a hip adductor stretch, FIG. 12 illustrates a hip joint stretch, and FIG. 13 illustrates a hip external rotator and extensor stretch. In other examples, FIG. 14 illustrates a seated knee flexor and hamstrings stretch, FIG. 15 illustrates a raised-leg knee flexor and hamstrings stretch, FIG. 16 illustrates a prone spine and shoulder stretch, and FIG. 17 illustrates a supine spine and shoulder stretch. FIG. 18 illustrates an example of a splits stretch along with the various muscles that may be affected.

In accordance with the variable positions, the user 50 may operate the apparatus 100 comprising various reps, which may comprise various time intervals and/or in a graduated fashion (or other custom designed fashion) increase and/or decrease the tensions.

In accordance with various embodiments, the apparatus 100 may comprise various internal operating components, such as the motor 160 to facilitate the use of the apparatus 100. For example, the motor 160 may be suitably coupled to the cable 745 to retract and/or feed the cable 745. In another embodiment, the motor 160 may be suitably coupled to the extension arm 746, and in still yet another embodiment the motor 160 may be suitably coupled to the footholds 120, or perhaps suitably coupled to the user support 110, such as a movable seat. The motor 160 may be suitably coupled to any one or any combination of these components as well as others now known or developed in the future.

It should further be noted that the motor 160 is merely one internal element configured to facilitate actuating the various components of the apparatus 100, and other internal elements are contemplated by this disclosure. For example, other internal components may comprise various combinations of drives, pulleys, gears, pistons, rods, shocks, sprockets, chains, belts, and the like, to facilitate operation of the apparatus 100.

In accordance with various embodiments, the apparatus 100 may comprise various electronics 170 to further facilitate use of the apparatus 100. As briefly described throughout, the electronics 170 may be suitably coupled to various components to receive input, such as power from a power cord, communication from the control communication cable 834, drive and/or operating information from the motor 160, the cable 745, the extension arm 746, the footholds 120, and the like. The electronics 170 may also be suitably coupled to various components to provide output, such as communication to the control communication cable 834, drive and/or operating information to the motor 160, the cable 745, the extension arm 746, the footholds 120, and the like. Among the various embodiments, the electronics 170 may also comprise various memory components, processors, drives, and the like.

In accordance with one embodiment, the apparatus 100 may comprise the enclosure 150. The enclosure 150 may house various operating components of the apparatus 100, such as the motor 160, electronics 170, as well all or a portion of the cable system 140. The enclosure 150 may also provide a top surface to secure the user support 110, such as a bench. The enclosure 150 may also comprise a structure to provide couplings for the footholds 120, the extension arm 746, etc. It should be noted that among the various embodiments, the enclosure 150 may be configured to house certain components, but other embodiments may comprise such components to be positioned outside of the enclosure 150 or completely apart from the enclosure 150. For example, components such as the motor 160, the electronics 170, portions of the cable system 140, etc., may be positioned outside or completely apart from the enclosure 150.

Various embodiments of the apparatus enable multiple methods of stretching. The apparatus can include a frame that is attached to a motor. One end of a cable is attached to the motor. The cable wraps around a pulley that is attached to the frame. The cable attaches to a handle which is integrated with the apparatus's controls. The user grasps the handle during some stretching exercises. An attachment for stretching one's legs is also coupled to the frame and the motor. The user's foot is placed on a foothold. There may be multiple footholds, accommodating the knee being straight or bent. The position of the foothold may also be adjusted, in order to accommodate users of varying heights. The attachment is controlled and can be moved outward from the frame, inducing a stretch in the user's leg. The system controls will also consist of electronics containing memory, which will enable the apparatus to run a predetermined program or to repeat the same stretches done in a previous exercise session.

Various embodiments provide a method comprising the steps of positioning a body on a platform, grasping handle 130, activating a controller interfaced to motor 160, controlling a tension of cable 140 coupled to motor 160 and handle 130, and stretching at least one muscle in the body. The method can further comprise releasing the tension in cable 140. The method can further comprise the steps of positioning a leg on a leg component, activating a controller interfaced to a motor 160, and stretching at least one muscle in the leg.

Various embodiments provide a method comprising the steps of rotating cable 140 coupled to motor 160 on one end of cable 140 and to a body interface to create resistance on a body part coupled to the body interface, and motor 160 controls the resistance on the body part. The cable 140 rotation can be controlled by motor 160. The cable 140 can be attached to handle 130. The cable 140 can attach to a leg component.

As illustrated in FIG. 10A, a method of stretching can include stretching muscles of at least one leg of the user 50. According to the method, the user 50 may be positioned on the user support 110 of the apparatus 100, in a seated position faced toward the control handle 130 of the apparatus 100. The feet of the user 50 can be positioned in footholds 120, such that the position of the knees of the user 50 is substantially straight. The method can include positioning the control handle 130 in the hands of the user 50 and the user 50 grasping the control handle 130. The method can comprise the user 50 activating the apparatus 100 by initiating the motor 160 by activating at least one component on the control handle 130. The method can further comprise the user 50 controlling the rotation of the motor 160 by activating at least one component found on the control handle 130. Alternatively, another person, such as, for example, a trainer, a therapist, a health professional, or a caretaker may initiate and control the motor 160 by activating at least one component on the control handle 130 or a remote control.

The method can further comprise the motor causing a tension in cable system 140, such that the foothold member 120 may move pivotally away from the body of the apparatus 100 in the direction of arrow 108, positioning the user 50 substantially in the position illustrated in FIG. 10A, where the legs of user 50 are substantially straight, are substantially positioned in the footholds 120, and are spread away from each other. This position may be held for a period of time. After the period of time, the user 50 may release the tension in the cable system 160 by activating at least one component on the control handle 130, thereby releasing the tension in the foothold members 120. According to one embodiment, the tension may be released slowly, allowing the legs of the user 50 to return to an unstretched position and the foothold members 120 to move pivotally towards the structure of apparatus 100 in the direction of arrow 109 in a controlled and deliberate manner. Alternatively, another person may release the tension in the cable system 140 by activating at least one component on the control handle 130 or a remote controller.

One embodiment can comprise a memory interfaced with the apparatus 100 that may record stretching sessions of the user 50. The duration and distance of the stretch of the user 50 may be recorded by the memory. The method can comprise the routine that may be repeated or modified according to the desires of the user 50 during future sessions. For example, a user in physical therapy may need to progressively alter a stretching routine. In the initial stages of therapy, the patient may have very limited stretching mobility. Helping a patient regain flexibility may be part of the therapy. In such cases, it is very useful to have the patient's stretching history available so that the therapist may gage the patient's progress and help the patient achieve the desired flexibility. During therapy sessions, the therapist may use the memory in apparatus 100 to perform the most recent session's stretching routines and subsequently use, to stretch the patient further than before to aid the patient's recovery. The memory may be downloaded to a computer to chart progress or to provide reports, for example, the medical provider of the user 50.

As illustrated in FIG. 10B, the method of stretching muscles can include stretching at least one muscle of the user 50. The method can comprise the user 50 starting in the position illustrated in FIG. 10A. This method can comprise the user 50 activating the motor 160 using the control handle 130. The method further can comprise the user 50 controlling the rotation of the motor 160 by activating at least one component on the control handle 130, such that a tension in the cable system 140 is created as the motor 160 rotates. Alternatively, another person may activate the motor 160 and control the motor rotation using the control handle 130 or a remote control. As motor 160 rotates, the tension in the cable system 140 increases, pulling the upper body of the user 50 forward in the direction of arrow 105 into a position similar to the position illustrated in FIG. 10B where the legs of user 50 are spread as illustrated in FIG. 10A and the torso of user 50 is bent forward, toward the user support 110. This method can cause a stretch in at least one of the muscles of the user 50. The method can include holding this position for a period of time. After the period of time, the user 50 may activate at least one component on the control handle 130 to release the tension in the cable system 140. Alternatively, another person may activate at least one component on the control handle 130 or on a remote controller to release the tension in the cable system 140.

According to the method, the user 50 to may return to the upright position illustrated in FIG. 10A as the tension in cable system 140 is released and as the user 50 move in the direction of arrow 106. The method further can comprise the stretching routine being recorded in the memory interfaced with the apparatus 100. The method can comprise recording at least one of the duration and distance of the stretches, as well as recording the time and date of the stretching routine. The method can comprise the same routine being repeated or modified according to the desires of the user 50 during future sessions, as described herein. The method can further comprise downloading the information to a computer for additional uses as described herein.

As illustrated in FIG. 11 a method of stretching can include stretching at least one muscle in the body of the user 50. The method consists of placing the user 50 on the user support 110 of the apparatus 100. The user 50 is positioned on the apparatus 100 such that the user 50 is seated facing the control handle 130. The method also can comprise positioning the feet of the user 50 on the user support 110 such that the feet are substantially close to the body and are substantially resting on their sides, and the knees of the user 50 are substantially spread away from the body. This may be referred to as a butterfly position. The method further can comprise positioning the control handle 130 in the hands of the user 50, such that the user 50 may grasp the control handle 130. The method can comprise the user 50 activating at least one component on the control handle 130 that activate the motor 160 and control the motor rotation. Alternatively, another person may activate the motor 160 and control the motor rotation using the control handle 130 or a remote control. The method can comprise the motor 160 rotating and creating a tension in the cable system 140 causing the user 50 to be pulled forward in the direction of arrow 105, causing a stretch in the muscles of the user 50. The method can comprise holding this position for a period of time. After the period of time, the user 50 may activate at least one component on the control handle 130 to release the tension in the cable system 140. Alternatively, another person may release the tension in the cable system 140 by activating at least one component on the control handle 130 or on a remote controller.

According to the method, the user 50 may return to the upright position illustrated in FIG. 11 as the tension in cable system 140 is released and the user 50 moves in the direction of arrow 106 in a controlled and deliberate manner. The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

As illustrated in FIG. 12 a method of stretching can include stretching at least one muscle of user 50. According to the method, the user 50 may be positioned on the user support 110 of the apparatus 100, such that the user 50 is seated facing toward the control handle 130 of the apparatus 100. The feet of the user 50 may be positioned in footholds 222, such that the knees of the user 50 are substantially bent and the user 50 is substantially straddling the apparatus 100 and the user support 110. The method includes positioning the control handle 130 in the hands of the user 50 and the user 50 grasping the control handle 130. The method can comprise the user 50 activating the motor 160 and controlling the motor rotation using the control handle 130. Alternatively, another person may activate the motor 160 using the control handle 130 or a remote control. The method further can comprise the motor 160 rotating and causing a tension that moves the foothold members 120 pivotally away from the body of the apparatus 100, substantially in the direction of arrow 108, positioning the user 50 substantially in the position illustrated in FIG. 12. This position may be held for a period of time. After the period of time, the user 50 may release the tension in the cable system 140, releasing the tension in the foothold members 120. Alternatively, another person may release the tension in the cable system 140 by activating at least one component on the control handle 130 or on a remote controller.

According to one embodiment, the tension may be released slowly, allowing the foothold members 120 to move pivotally toward the structure of the apparatus 100, substantially in the direction of arrow 109, and the legs of the user 50 to return to an unstretched position in a controlled and deliberate manner. The method also can comprise the user 50 in the position illustrated in FIG. 12 and the motor 160 rotating such that there is a tension in the cable system 140 that cause the upper body of the user 50 to move substantially in the direction of the arrow 105, causing a stretch in the muscles of the user 50. The tension may be released as described herein, with the user 50 moving substantially in the direction of arrow 106 and returning to the position illustrated in FIG. 12. The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

With reference to FIG. 13, a method of stretching according to various embodiments is illustrated. This method can comprise positioning a user 50 on the user support 110 of the apparatus 100 such that the user 50 is seated facing the control handle 130. The method can comprise positioning one of the feet of the user 50 in a foothold 120 of the apparatus 100, such that the leg of the user 50 is substantially straight and positioning the other foot of the user 100 in a substantially flush position against the inner thigh of the first leg of user 50. The user 50 may activate the motor 160 and control the motor rotation by activating at least one component on the control handle 130. Alternatively, another person may activate the motor 160 and control the motor rotation using the control handle 130 or a remote controller.

The method can comprise the motor 160 rotating, creating a tension in cable system 140 as the cable moves in the direction indicated by the arrow 105, and causing the user 50 to move substantially in the direction of arrow 105, causing a stretch in the muscles of the user 50. After holding the stretch for a period of time the user 50 may release the tension in the cable system 140 by activating at least one component on the control handle 130, allowing the user 50 to move in the direction of arrow 106 and return to the initial position illustrated in FIG. 13 in a deliberate and controlled manner as the tension in the cable system 140 is released. Alternatively, another person may release the tension in cable system 140 by activating at least one component on the control handle 130 or on a remote controller. The method further can comprise performing the stretching sequence with the left leg being straight and the right foot being against the left thigh (as illustrated in FIG. 13) and the right leg being straight and the left foot being against the right thigh (not illustrated). The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

With reference to FIG. 14 a method of stretching according to various embodiments is illustrated. This method can comprise positioning a user 50 on the user support 110 of the apparatus 100 such that the user 50 is seated facing the control handle 130. The method can comprise positioning both of the feet of the user 50 in the footholds 120 of the apparatus 100. The method further can comprise positioning the control handle 130 in the hands of the user 50. The user 50 may activate the motor 160 and control the motor rotation by activating at least one component on the control handle 130. Alternatively, another person may activate the motor 160 by activating at least one component on the control handle 130 or on a remote control.

The method can comprise the motor 160 rotating, creating a tension in cable system 140, moving the user 50 substantially in the direction of the arrow 105, and causing a stretch in the muscles of the user 50. After holding the stretch for a period of time the user may release the tension in the cable system 140, by activating at least one component on the controller handle 130. Alternatively, another person may release the tension in the control handle 130 by activating at least one component on the control handle 130 or on a remote control. The method can comprise the user 50 moving in the direction of arrow 106 as the tension in cable system 140 is released and returning to the initial position illustrated in FIG. 14 in a deliberate and controlled manner. The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

With reference to FIG. 15 a method of stretching according to various embodiments is illustrated. This method can comprise positioning a user 50 on the user support 110 of the apparatus 100 such that the user 50 faces the control handle 130. The method can comprise positioning one of the feet of the user 50 in the foothold 120 of the apparatus 100 and positioning the other foot of the user 50 in the foothold 222. The method further can comprise positioning the control handle 130 in the hands of the user 50. The user 50 may activate the motor 160 and control the motor rotation by activating at least one component on the control handle 130. Alternatively, another person may activate the motor 160 and control the motor rotation using the control handle 130 or a remote control. The method can comprise the motor 160 rotating, creating a tension in cable system 140, pulling the upper body of the user 50 substantially in the direction of the arrow 105, and causing a stretch in the muscles of the user 50. After holding the stretch for a period of time the user 50 may release the tension in the cable system 140, by activating at least one component on the controller handle 130 or on a remote control. Alternatively, another person may release the tension in the control handle 130 by activating at least one component on the control handle 130 or on a remote control.

The method can comprise the user 50 moving in the direction of arrow 106 as the tension in cable system 140 is released and returning to the initial position illustrated in FIG. 15 in a deliberate and controlled manner. The method also can comprise the left foot of the user 50 being positioned in foothold 120 and the right foot being positioned in foothold 222 (as illustrated in FIG. 15) and the left foot being positioned in foothold 222 and the right foot being positioned in foothold 120 (not illustrated). The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

With reference to FIG. 16 a method of stretching according to various embodiments is illustrated. This method can comprise positioning the torso of a user 50 on the user support 110 of the apparatus 100 such that the user 50 is positioned chest-down on the user support 110 and such that the knees of the user 50 may be positioned on the user support 110 of the apparatus 100. The method further can comprise positioning the control handle 130 in the hands of the user 50. The user 50 may activate the motor 160 and control the motor rotation by activating at least one component on the control handle 130. Alternatively, another person may activate the motor 160 and control the motor rotation using the control handle 130 or a remote control. The method can comprise the motor 160 rotating, creating a tension in cable system 140, moving the user 50 substantially in the direction of the arrow 105, and causing a stretch in the muscles of the user 50. After holding the stretch for a period of time the user 50 may release the tension in the cable system 140 by activating at least one component on the controller handle 130. Alternatively, another person may release the tension in the control handle 130 by activating at least one component on the control handle 130 or on a remote control.

The method can comprise user 50 moving in the direction of arrow 106 as the tension in cable system 140 is released and returning to the initial position illustrated in FIG. 16 in a deliberate and controlled manner. The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

With reference to FIG. 17 a method of stretching according to various embodiments is illustrated. This method can comprise positioning the torso of a user 50 on the user support 110 of the apparatus 100 such that the user 50 is positioned back-down on the user support 110 and such that the feet of the user 50 may be positioned on the user support 110 of the apparatus 100. The method further can comprise positioning the control handle 130 in the hands of the user 50. The user 50 may activate the motor 160 by activating at least one component on the control handle 130. Alternatively, another person may activate the motor 160 using the control handle 130 or a remote control.

The method can comprise the motor 160 rotating, creating a tension in cable system 140, moving the user 50 substantially in the direction of the arrow 105, inducing a stretch in the muscles of the user 50. After holding the stretch for a period of time the user 50 may release the tension in the cable system 140 by activating at least one component on the controller handle 130. Alternatively, another person may release the tension in the control handle 130 by activating at least one component on the control handle 130 or on a remote control. The method can comprise user 50 moving in the direction of arrow 106 as the tension in cable system 140 is released and returning to the initial position illustrated in FIG. 17 in a deliberate and controlled manner. The method further can comprise the stretching sequence being recorded in a memory interfaced with the apparatus 100, such that the duration and distance of the stretch are recorded and are able to be repeated or modified according to the desires of the user 50 during a future stretching session, as described herein. The method can further comprise downloading the information to a computer for additional uses as described herein.

With reference to FIG. 18, a method of stretching can include stretching muscles of at least one leg of the user 50. According to the method, the user 50 may be positioned on the user support 110 of the apparatus 100, in a seated position faced toward the control handle 130 of the apparatus 100. The feet of the user 50 can be positioned in footholds 120, such that the position of the knees of the user 50 is substantially straight. The method can include positioning the control handle 130 in the hands of the user 50 and the user 50 grasping the control handle 130. The method can comprise the user 50 activating the apparatus 100 by initiating the motor 160 by activating at least one component on the control handle 130. The method can further comprise the user 50 controlling the rotation of the motor 160 by activating at least one component found on the control handle 130. Alternatively, another person, such as, for example, a trainer, a therapist, a health professional, or a caretaker may initiate and control the motor 160 by activating at least one component on the control handle 130 or a remote control.

The method can further comprise the motor causing a tension in cable system 140, such that the foothold member 120 may move pivotally away from the body of the apparatus 100 in the direction of arrow 108, positioning the user 50 substantially in the position illustrated in FIG. 18, where the legs of user 50 are substantially straight, are substantially positioned in the footholds 120, and are spread away from each other. This position may be held for a period of time. After the period of time, the user 50 may release the tension in the cable system 160 by activating at least one component on the control handle 130, thereby releasing the tension in the foothold members 120. According to one embodiment, the tension may be released slowly, allowing the legs of the user 50 to return to an unstretched position and the foothold members 120 to move pivotally towards the structure of apparatus 100 in the direction of arrow 109 in a controlled and deliberate manner. Alternatively, another person may release the tension in the cable system 140 by activating at least one component on the control handle 130 or a remote controller.

One embodiment can comprise a memory interfaced with the apparatus 100 that may record stretching sessions of the user 50. The duration and distance of the stretch of the user 50 may be recorded by the memory. The method can comprise the routine that may be repeated or modified according to the desires of the user 50 during future sessions. For example, a user in physical therapy may need to progressively alter a stretching routine. In the initial stages of therapy, the patient may have very limited stretching mobility. Helping a patient regain flexibility may be part of the therapy. In such cases, it is very useful to have the patient's stretching history available so that the therapist may gage the patient's progress and help the patient achieve the desired flexibility. During therapy sessions, the therapist may use the memory in apparatus 100 to perform the most recent session's stretching routines and subsequently use, to stretch the patient further than before to aid the patient's recovery. The memory may be downloaded to a computer to chart progress or to provide reports, for example, the medical provider of the user 50.

Figure 19:
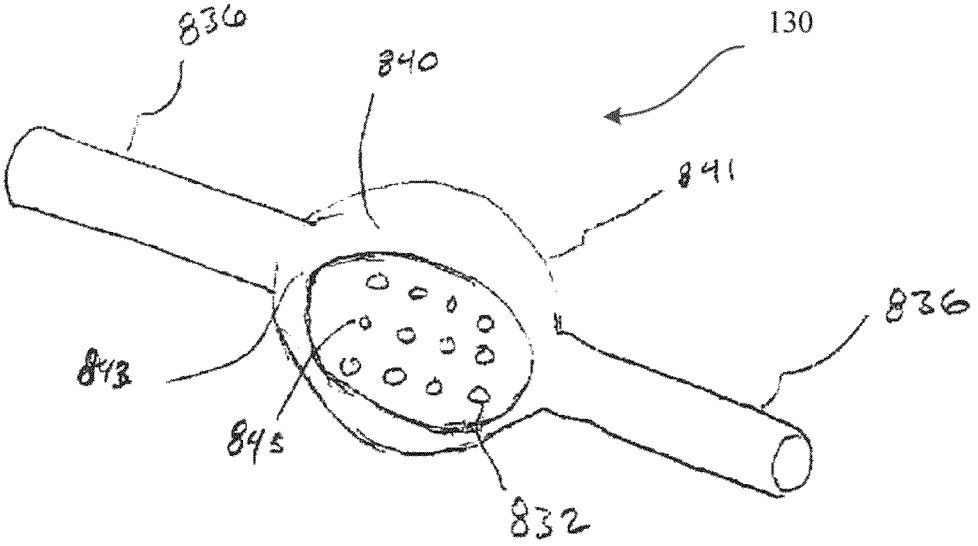
FIG. 19 is a prospective view illustrating a control handle, according to one embodiment.

In some embodiments and in reference to FIG. 19, handle 130 comprises a pair of hand grips 836 and a center member 840. The hand grips 836 are coupled to the center member, such that the center member 840 is substantially centered between the hand grips 836. The center member 840 may also be coupled to a back plate 841. The back plate 841 may comprise multiple openings that may be coupled to circuitry for controlling the motion of apparatus 100. The circuitry may be coupled to the back plate 841 by any means. For example, the circuitry may be coupled to the back plate 841 by the use of glue and/or one or more fasteners such as, for example, screws rivets, bolts, hook and loop, tongue and groove, or a collar. The circuitry may be coupled to the back plate 841 such that the circuitry passes through at least one opening in the back plate 841. However, in one embodiment, the circuitry may be connected wirelessly, thus eliminating such an opening. The back plate 841 may be fastened to the center member 840 by any means. For example, the back plate 841 may be fastened by the use of screws, bolts, or rivets. The circuitry coupled to the back plate 841 may be contained within the center member 840. A front plate 843 may be fastened to the center member 840.

Activation components 845, such as buttons, keys, or switches may be coupled to the front plate 843 by any means. For example, the Activation components 845 may be coupled to the front plate 843 using fasteners. The circuitry may be coupled to the front plate 843 and to the Activation components 845 by any means. For example, the circuitry may be coupled to the Activation components 845 by solder, and or by other means, such as, for example, glue or fasteners. The circuitry may be coupled to the front plate 843 by the use of glue and/or one or more fasteners such as, for example, screws rivets, bolts, hook and loop, tongue and groove, or a collar.

However, in one embodiment, the circuitry may be connected wirelessly, thus eliminating such connections. Further, the circuitry may be responsive to the Activation components 845, such that the apparatus 100 may move to a determined position in response to activating at least one of the Activation components 845. The circuitry may be interfaced with the motor 160 such that the user 50 may activate an Activation component 845, which may cause a signal to be sent to the circuitry, which may cause the motor 160 to activate such that the various parts of the apparatus 100, such as the leg supports, footholds, and handle 130, may move. The circuitry may be arranged such that activating one Activation component 845 would activate only one part of the apparatus 100, such as for example, moving a foothold pivotally outward from the apparatus 100, for example as shown in FIG. 12. The end of the circuitry opposite the end attached to the Activation components 845 may be coupled to the motor 160 by any means, such as, for example, using solder, glue, or a fastener adequate to join the circuitry to the motor 160. However, in one embodiment, the circuitry may be connected wirelessly, thus, eliminating such a connection to the motor.

Figure 20:
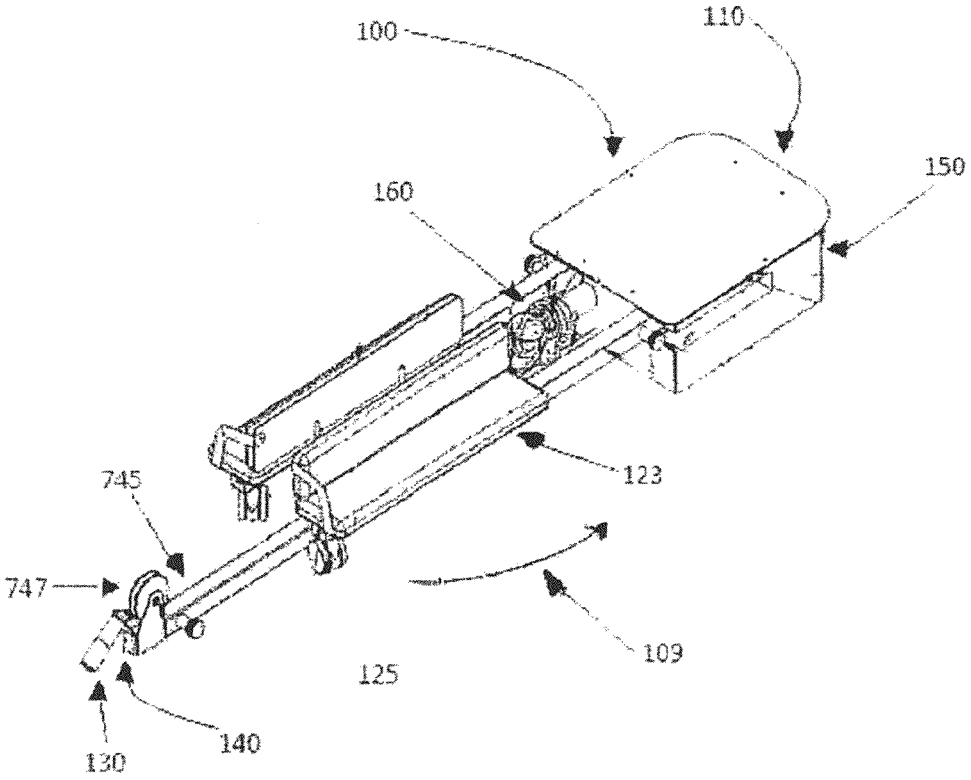
FIG. 20 is a top prospective view of an apparatus according to various embodiments.

Various embodiments enable multiple methods of stretching. Various embodiments may comprise an apparatus 100 that may be positioned on a surfaced that is substantially flat, as illustrated in FIG. 20. For example, the apparatus 100 may be placed on the floor of a user's home, on the floor of a physical fitness center, or on the floor of a health care provider's facility. The apparatus 100 comprises a housing 150 and a motor 160 that is coupled to the housing 150. Additionally, a cable system 140 may be coupled to the housing 150. The cable system 140 may comprise a cable 745 and a center mounted disk 747, such as a pulley. One end of the cable 745 may be coupled to the motor 160. The cable 745 may be coupled to the center mounted disk 747, such that the cable 745 wraps around the center mounted disk 747. The other end of the cable 745 may attach to a control handle 130. Control handle 130 may comprise grips for both hands of user 50 and controls, such as switches, buttons, keys, knobs, levers, or other actuating devices for controlling the movement of apparatus 100.

A leg support 123 for stretching the legs of the user 50 may be coupled to the apparatus 100. The leg support 123 may also be coupled to the motor 160 such that the leg support 123 may be controlled and may be moved pivotally outward from the housing 150 (as illustrated by arrow 109), causing a stretch in the muscles of the user 50. The leg support 123 may be attached at one end to a mechanism that enables the leg support 123 to pivot outward from the body of the apparatus 100. At the other end of the leg support 123, a roller 125 may be attached to the leg support 123. The roller 125 may be in contact with the substantially flat surface. The roller 125 enables the leg support 123 to move pivotally outward from the housing 150. At least one of the legs of the user 100 may be placed on at least one of the leg supports 123. The leg support 123 may be adjustable in order to accommodate users of different heights. Additionally, the apparatus 100 may comprise electronics which may comprise a memory. The memory may store a predetermined stretching routine. The memory may also store a stretching routine performed by the user 50 such that the user 50 or another may repeat a sequence of stretches done in a previous stretching session during a later session. The user 50 or another may adjust or modify the previous stretches to meet the needs of the user 50, such as, for example, hold a stretch for a longer period of time, move the leg supports 123 pivotally outward further than in the previous session, or other adjustments according to the desires of the user 50.

Figure 21:
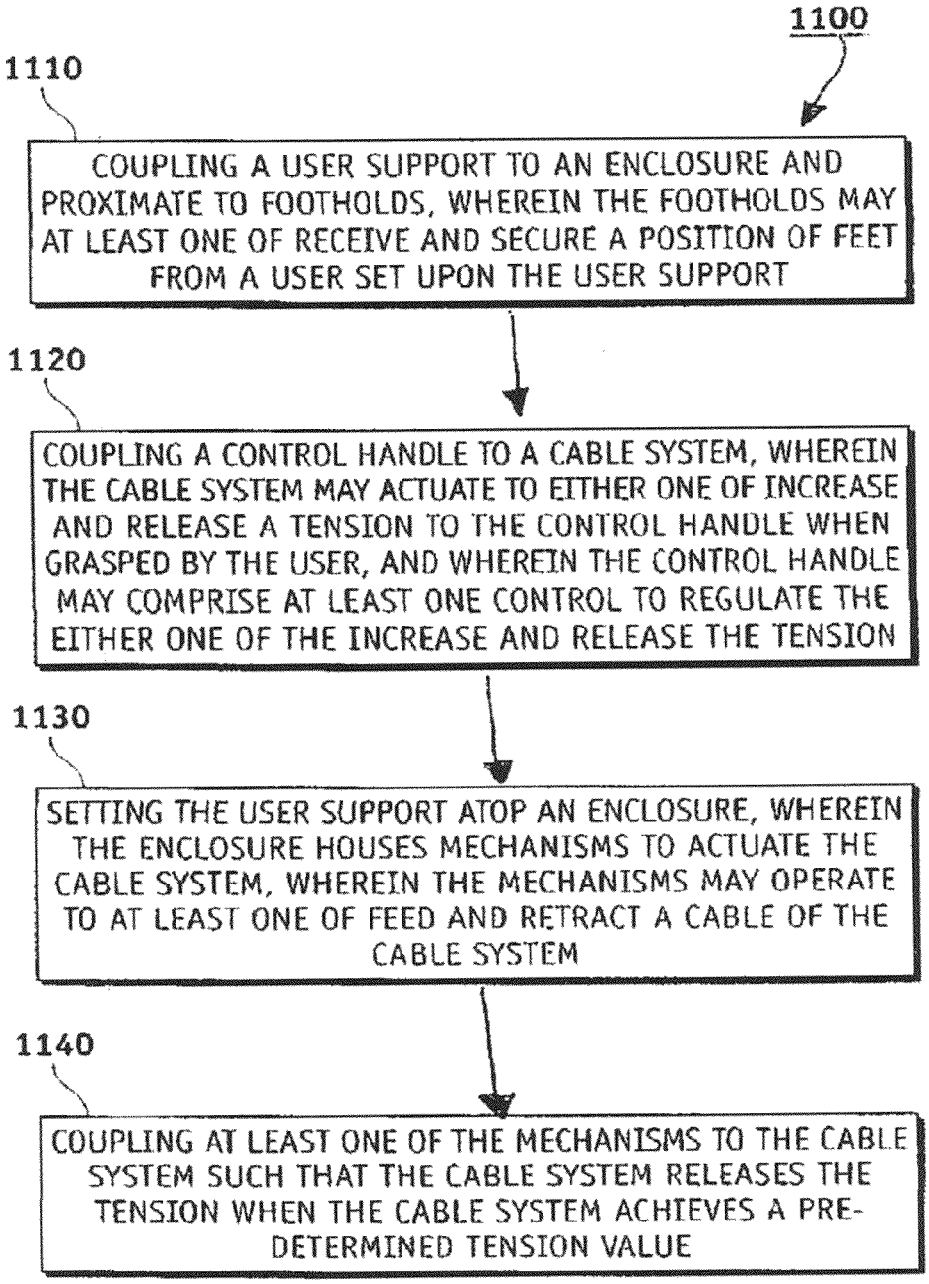
FIG. 21 is a flow chart illustrating a method of manufacturing an apparatus according to various embodiments.

In accordance with one embodiment, and with reference to the flow chart illustrated by FIG. 21, a method 1100 for manufacturing an apparatus, such as apparatus 100, may comprise coupling a user support to an enclosure and proximate to footholds, wherein the footholds may at least one of receive and secure a position of feet from a user set upon the user support (1110). The method 1100 may further comprise coupling a control handle to a cable system, wherein the cable system may actuate to either one of increase and release a tension to the control handle when grasped by the user, and wherein the control handle may comprise at least one control to regulate the either one of increase and release the tension (1120). In accordance with one embodiment, the method 1100 may further comprise setting the user support atop an enclosure, wherein the enclosure houses mechanisms to actuate the cable system, and wherein the mechanisms may operate to at least one of feed and retract a cable of the cable system (1130). The method 1100 may further comprise coupling at least one of the mechanisms to the cable system such that the cable system releases the tension when the cable system achieves a pre-determined tension value (1140).

In accordance with various embodiments, various methods may also comprise packaging the apparatus and/or system, marketing the apparatus and/or system, drafting instructions to use and/or assemble the apparatus and/or system, and the like. Among the various methods, the user support may be similar to user support 110 and/or 1010; the footholds may be similar to footholds 120 and/or 222, the control handle may be similar to control handle 130, the cable system may be similar to cable system 140, the cable may be similar to cable 745, the mechanisms may be similar to the motor 160 and/or the electronics 170, and the enclosure may be similar to the enclosure 150.

Figure 22:
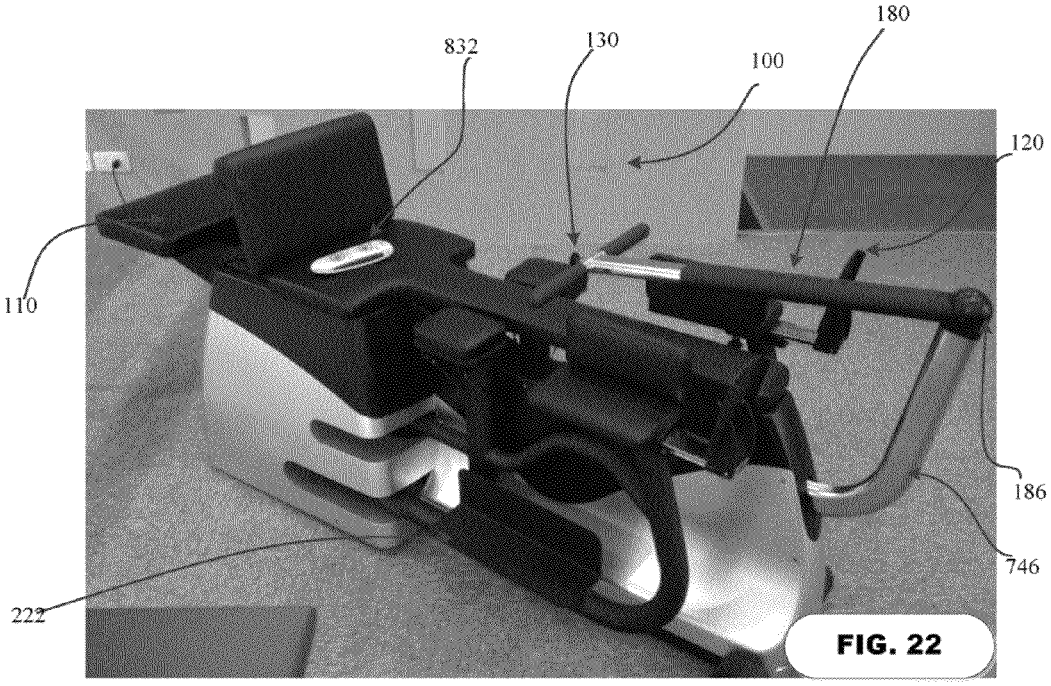
FIG. 22 is a prospective view illustrating an apparatus, in accordance various embodiments

With reference to FIG. 22, apparatus 100 is illustrated in accordance various embodiments. Apparatus 100 can comprise motor 160 coupled to arm 746 which is connected to adjustable member 180 with a pivoting linkage 186. In some embodiments, adjustable member 180 couples handle 132 to pivoting linkage 186.

In one embodiment, adjustable number 180 comprises an adjustment mechanism such as a screw linkage, holes and pins, compression adjustment, and the like. Adjustable member 180 can be varied in length to fit a variety of user sizes and weights.

In some embodiments, apparatus 100 and comprise motor 160, which can be controlled but electronics 170. In one embodiment, motor 160 moves arm 746 in a forward and/or a backward motion which is substantially parallel to support 110. In some embodiments controls 832 can be separate from handle 130. In one embodiment controls 832 to can be a remote control unit which can be in communication with electronics 170. In one embodiment, motor 160 includes hydraulics in which to drive at least one of arm 746 and foothold members 222. In various embodiments, foothold members 222 move in substantially the same pivot motion as described here. Any of the exercises described in FIG. 10-18 can be performed using apparatus 100 as illustrated in FIG. 22.

In various embodiments, apparatus 100 does not include a cable system. In one embodiment, arm 746 is coupled directly to motor 160. In some embodiments, cable system 140 is replaced with mechanical linkages and arms. In some embodiments, at least a portion of cable system 140 is replaced with a hydraulic system. In some embodiments, the cable system 140 is replaced with a combination of mechanical linkages and hydraulics. In some embodiments, at least one of the combination of mechanical linkages and hydraulics is coupled to motor 160. In one embodiment, foothold members 222 are coupled directly to motor 160. In one embodiment, arm 746 is coupled to a first motor of motor 160 and foothold members 222 or coupled to a second motor of motor 160. In some embodiments, first and second motors of motor 160 can be controlled by electronics 170 and programmed by controller 832. In one embodiment, motor 160 and/or electronics 170 is coupled to a power source such as a wall outlet. In one embodiment, motor 160 and/or electronics 170 is powered by a rechargeable battery system.

In some embodiments, as user 50 is holding handle 130 motion of arm 746 may cause adjustable member 182 and a direction perpendicular to support one time. As adjustable member 180 moves perpendicular to support 110, adjustable number 180 benefits on linkage 186 such that movement of arm 746 efficiently stretches user 50 of any size or weight.

In the foregoing specification, the invention has been described with reference to specific embodiments. Various modifications and changes may be made, however, without departing from the scope of the various embodiments, as set forth in the claims. The specification and figures are illustrative, rather than restrictive, and modifications are intended to be included within the scope of any of the various embodiments described herein. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus or system claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

The invention claimed is:

1. A physical fitness apparatus comprising:

a platform;

a motor coupled to the platform;

a seat mounted to the platform;

a rotating disk center-mounted to the platform;

a cable having a first end and a second end, and coupled to the motor at the first end and tolling on the rotating disk;

a handle coupled to the cable at the second end;

a pair of leg components pivotally coupled to the platform and in communication with the motor, wherein each leg component actuates in a lateral motion away from or toward the platform; and a controller interfaced to the motor and configured to control at least one of the cable tension and the motor rotation.

2. The apparatus according to claim 1 wherein the controller and the handle are integrated.

3. The apparatus according to claim 1 wherein the leg components comprises an adjustment mechanism configured to accommodate different sized bodies.

4. The apparatus according to claim 1 wherein the leg components further comprises at least one foothold.

5. The apparatus according to claim 4 wherein the at least one foothold comprises an adjustment mechanism configured to accommodate different sized bodies.

6. The apparatus according to claim 1 further comprising a memory system in communication with the controller.

7. The apparatus according to claim 1 wherein the motor is configured to increase tension and release tension in the cable.

8. A system for increasing flexibility for a user comprising:

a bench set atop an enclosure, which houses mechanisms to actuate a cable system, wherein the mechanisms feed and/or retract a cable of the cable system;

footholds proximate to the bench to support feet from a user, wherein the cable system actuates between the footholds, and wherein the footholds actuate in a lateral motion to further accentuate increasing flexibility; and a control handle coupled to the cable system for the user to grasp, wherein the cable system actuates to either one of increase and release a tension to the control handle, and wherein the control handle comprises at least one control to regulate the either one of increase and release the tension.

9. The system according to claim 8, wherein the bench and the footholds facilitate an operating position for the user, wherein the operating position comprises a seated straddled position when the user is set upon the bench and the user's feet are placed in the footholds.

10. The system according to claim 9, wherein feeding the cable increases an angle between a user's torso and the bench when the user is in the operating position and, wherein retracting the cable decreases the angle between a user's torso and the bench when the user is in the operating position.

11. The system according to claim 8, wherein at least one of the mechanisms is a motor coupled to the cable system and configured to communicate with the at least one control to regulate the either one of increase and release the tension.

* * * * *

UNITED STATES PATENT AND TRADEMARK OFFICE

CERTIFICATE OF CORRECTION

PATENT NO. : 9,050,486 B2
APPLICATION NO. : 13/185501
DATED : June 9, 2015
INVENTOR(S) : Michael Reed It is certified that error appears in the above-identified patent and that said Letters Patent is hereby corrected as shown below:

In the claims,
In column 20, claim 3, line 2, please delete “comprises” and insert --comprise--,
In column 20, claim 4, line 5, please delete “comprises” and insert --comprise--.

Signed and Sealed this
Thirteenth Day of October, 2015

Michelle K. Lee

Michelle K. Lee
*Director of the United States Patent and Trademark Office*